US005983059A

United States Patent [19]

Oka et al.

[11] Patent Number: 5,983,059

[45] Date of Patent: Nov. 9, 1999

[54] RECYCLABLE TONER CONTAINER FOR AN IMAGE FORMING APPARATUS

[75] Inventors: Seiji Oka, Kanagawa; Yasushi Akiba; Masumi Ikesue, both of Tokyo; Masakazu Nakada, Shizuoka; Hiroyasu Itou, Tokyo, all of Japan

[73] Assignee: Ricoh Company, Ltd., Tokyo, Japan

[21] Appl. No.: 08/925,146

[22] Filed: Sep. 8, 1997

[30] Foreign Application Priority Data

| | | | |
|---|---|---|---|
| Sep. 6, 1996 | [JP] | Japan | 8-236821 |
| Sep. 6, 1996 | [JP] | Japan | 8-236822 |
| Sep. 6, 1996 | [JP] | Japan | 8-236823 |
| Sep. 6, 1996 | [JP] | Japan | 8-236824 |
| Oct. 2, 1996 | [JP] | Japan | 8-261922 |
| Oct. 2, 1996 | [JP] | Japan | 8-261923 |
| Oct. 2, 1996 | [JP] | Japan | 8-261925 |
| Oct. 2, 1996 | [JP] | Japan | 8-261926 |
| Oct. 2, 1996 | [JP] | Japan | 8-261927 |

[51] Int. Cl.[6] ..... G03G 15/08

[52] U.S. Cl. ..... 399/262; 222/546; 222/547; 222/562; 222/563; 399/109

[58] Field of Search ..... 399/262, 109; 222/546, 544, 562, 563, 547

[56] References Cited

U.S. PATENT DOCUMENTS

| | | | |
|---|---|---|---|
| 3,318,496 | 5/1967 | Ayotte et al. | 222/546 |
| 3,400,866 | 9/1968 | Fatorri et al. | 222/546 X |
| 3,422,998 | 1/1969 | Murray | 222/563 X |
| 3,926,348 | 12/1975 | Lutzker | 222/563 X |
| 4,105,141 | 8/1978 | Lane et al. | 222/563 X |
| 4,171,749 | 10/1979 | Obrist et al. | 222/546 X |
| 4,217,988 | 8/1980 | Mills et al. | 222/547 X |
| 4,362,255 | 12/1982 | Bond | 222/563 X |
| 4,611,899 | 9/1986 | Kasamura et al. . | |
| 4,878,603 | 11/1989 | Ikesue et al. . | |
| 5,008,709 | 4/1991 | Shinada et al. . | |
| 5,096,177 | 3/1992 | Saeki et al. . | |
| 5,261,567 | 11/1993 | Krall | 222/563 X |
| 5,576,816 | 11/1996 | Staudt et al. | 399/262 |
| 5,765,079 | 6/1998 | Yoshiki et al. | 399/262 X |
| 5,822,663 | 10/1998 | Ichikawa et al. | 399/262 |

FOREIGN PATENT DOCUMENTS

| | | |
|---|---|---|
| 0 132 019 | 1/1985 | European Pat. Off. . |
| 0 604 999 | 7/1994 | European Pat. Off. . |
| 4-366982 | 12/1992 | Japan . |
| 7-28316 | 1/1995 | Japan . |
| 2 219 529 | 12/1989 | United Kingdom . |
| 2 244 694 | 12/1991 | United Kingdom . |
| 2 288 529 | 10/1995 | United Kingdom . |
| WO 88/00167 | 1/1988 | WIPO . |

*Primary Examiner*—Susan S.Y. Lee
*Attorney, Agent, or Firm*—Oblon, Spivak, McClelland, Maier & Neustadt, P.C.

[57] ABSTRACT

A recyclable toner container having a hollow cylindrical body, a toner outlet at one end of the container, and a removable cap fitted in the toner outlet. The cap have a plurality of circumferential protuberances on an outer periphery thereof and contacting the inner periphery of the toner outlet. The diameters of the plurality of protuberances are sequentially increased from a downstream side toward an upstream side in a direction in which the cap is inserted into the toner outlet.

3 Claims, 30 Drawing Sheets

RECYCLABLE TONER CONTAINER FOR AN IMAGE FORMING APPARATUS

BACKGROUND OF THE INVENTION

The present invention relates to recycling of expendables included in a copier, facsimile apparatus, laser printer or similar image forming apparatus and, more particularly, to a recyclable toner container storing toner to be replenished into a developing unit included in the image forming apparatus.

Today, recycling articles customarily disposed of as expendables is one of major social demands from the standpoint of the effective use of limited resources and environmental protection. In an image forming apparatus, for example, expendables including a photoconductive element and a toner container should preferably be recycled. The toner container, for example, may be collected and again filled with toner to be reused or may be shreded into pellets, melted, and then reclaimed in the form of a molding.

However, conventional toner container recycling schemes, whether they reuse collected toner containers or reclaim them, have the following problems (1)–(5) left unsolved.

(1) Generally, toner containers themselves are not standardized as to their configuration, size, material, etc. Specifically, each manufacturer produces toner cartridges of a particular configuration and size fitting for their own machines or products. In addition, even a single manufacturer often varies the configuration and size of toner cartridges, depending on the type of machines. It is therefore difficult to collect a great number of toner containers of identical configuration, and therefore to efficiently reuse toner containers. These problems will be solved if all the different types of machines share a single kind of toner containers identical in configuration, size, material, etc. This kind of scheme surely increases the number of toner containers to be collected, and in addition reduces the production cost. However, when identical toner containers are shared by different types of machines, it is likely that a toner container storing a particular kind of toner is accidentally mounted to an image forming apparatus including a developing system expected to use a different kind of toner. In light of this, Japanese Patent Laid-Open Publication No. 7-168430 proposes to form each toner container with a lug at a particular position in order to indicate the kind of toner stored therein.

The approach taught in the above document successfully prevents the accidental setting of a toner container storing an unexpected kind of toner. However, the position of the lug and therefor the overall configuration differs from one toner container to another toner container. This prevents different types of a machines from sharing substantially all the toner containers, and therefore prevents a great number of toner containers to be collected and reused.

(2) The collected toner containers, whether they are to be reused or reclaimed, should be surely cleaned by air, water or the like in order to remove toner remaining therein. Assume that toner is left in a toner container collected and then refilled with toner. These, the toner is apt to cohere and reach a developing unit, resulting in a locally omitted solid image, as well known in the art. When toner is left in a toner container to be reclaimed in the form of a new molding, it is likely that the toner provides the molding with an unexpected characteristic or an unexpected color. For example, when the toner remaining in the toner cartridge is black, the molding expected to be white may become gray. In any case, it is not desirable to reuse or reclaims a toner container of low degree of cleaning.

Japanese Patent Laid-Open Publication Nos. 60-159769 and 7-159769, for example, each teaches a container for storing toner to be consumed or carrier to be deteriorated due to aging. The container is formed with a spiral ridge for a guide. While the container is in rotation, the spiral ridge drives toner or carrier toward an outlet formed in the container. A container lacking such a spiral ridge is also proposed. In any case, the container has a stepped portion between its body and the toner outlet. The toner outlet has a smaller diameter than the container body.

When the above container is collected and cleaned by water or air, the stepped portion and the small diameter of the toner outlet prevent toner or carrier remaining in the container from being fully removed despite repeated cleaning. Particularly, it is difficult to remove the entire toner or carrier remaining in the stepped portion and the bottom of the container and on the surfaces of the spiral ridge.

(3) When a collected toner container is to be reused after cleaning, whether or not it will withstand reuse must be determined by a test. This is because the dimensions of the container are apt to vary more than expected due to conditions in which the container was dealt with in the past. Particularly, the toner outlet or mouth of a toner container is apt to deform. If the diameter of the toner outlet is increased beyond a standard range, a cap fitted in the toner outlet at the time of reuse is apt to slip out and cause refilled toner to leak. Such a collected toner is not suitable for reuse and is excluded. This, however, reduces the number of containers which can be recycled, and thereby lowers profit. While the diameter of the toner outlet is measured by a contact type test, the measurement is not easy because the container is generally soft and long.

(4) Whether or not a collected toner container will withstand reuse should preferably be determined without any test. Specifically, if how many times the collected container has been reused in the past is known, containers reached a preselected frequency of recycling can be readily delivered to a reclaiming line and used as a reclaimed material for a new molding, However, this kind of implementation has not been reported yet.

(5) The State government of California, U.S.A, enforced a plastic container control law in June, 1995 in relation to the reclamation of toner containers not withstanding further reuse. The control law prescribes the use of PCR (Post Consumer Resin). PCR is produced when, e.g., a used hard polyethylene resin container (HDPE) is cleaned and then shreded, melted and pelletized after the removal of a label. PCR, however, cannot restore the natural color of a virgin material, but appears yellow-gray, despite the careful cleaning of the collected container. This is because toner remaining in the collected container cannot be fully removed by cleaning and is introduced into resin chips. As a result, PCR or reclaimed material varies in melt flow rate, fluxural strength, deflection temperature under load, specific gravity, and so forth, compared to a virgin material. The problem is therefore whether or not PCR can be handled in the same manner as a virgin material. Particularly, when the container formed of such a material is applied to an image forming apparatus, it must have an acceptable degree of flame retardation.

SUMMARY OF THE INVENTION

It is therefore an abject of the present invention to provide a recyclable toner container for an image forming apparatus and capable of solving the problems (1)–(5) discussed above.

In accordance with the present invention, a recyclable toner container for storing toner to be replenished into a developing device of an image forming apparatus has a hollow cylindrical container body, a toner outlet formed in one end of the container body, and an unreplaceable member removably fitted on the container body. The container body includes engaging portion having a particular configuration representative of the kind of toner stored in the toner container.

Also, in accordance with the present invention, a recyclable toner container for storing toner to be replenished into a developing device of an image forming apparatus has a hollow cylindrical container body formed with a bulge portion at one end thereof. The bulge portion forms a shoulder portion. A toner outlet is formed in the bulge portion of the shoulder portion, The inner periphery of the end of the bulge portion and the inner periphery of the toner outlet make an angle of at least 90 degrees therebetween.

Also, in accordance with the present invention, a recyclable toner container for storing toner to be replenished into a developing device of an image forming apparatus has a hollow cylindrical container body, a toner outlet formed in one end of the container body, and a redirecting portion formed in the bottom of the toner container remote from the toner outlet for scattering a fluid jetted toward the bottom within the container body.

Further, in accordance with the present invention, a recyclable toner container for storing toner to be replenished into a developing device of an image forming apparatus has a hollow cylindrical container body, a toner outlet formed in one end of the container body and having a diameter smaller than the diameter of the container body, and a spiral ridge formed in the inner circumferential wall of the container body. The spiral ridge is rounded at each corner thereof.

Furthermore, in accordance with the present invention, a recyclable toner container for storing toner to be replenished into a developing device of an image forming apparatus has a hollow cylindrical container body, a toner outlet formed in end of the container body, and a cap removably fitted in the toner outlet. The cap has at least one circumferential protuberance formed on the outer periphery thereof contacting the inner periphery of the toner outlet.

Moreover, in accordance with the present invention, a recyclable toner container for storing toner to be replenished into a developing device of an image forming apparatus has a hollow cylindrical container body, a toner outlet formed in one end of the container body, and at least one protuberance formed on the outer periphery of the toner outlet.

In addition, in accordance with the present invention, a recyclable toner container for storing toner to be replenished into a developing device of an image forming apparatus has a hollow cylindrical container body, a toner outlet formed in one end of the container body, and an indication for indicating how many times the toner container can be reused.

BRIEF DESCRIPTION OF THE DRAWINGS

The above and other objects, features and advantages of the present invention will become apparent from the following detailed description taken with the accompanying drawings in which.

In the figures, identical references denote identical structural elements.

DESCRIPTION OF THE PREFERRED EMBODIMENTS

Figure 1:
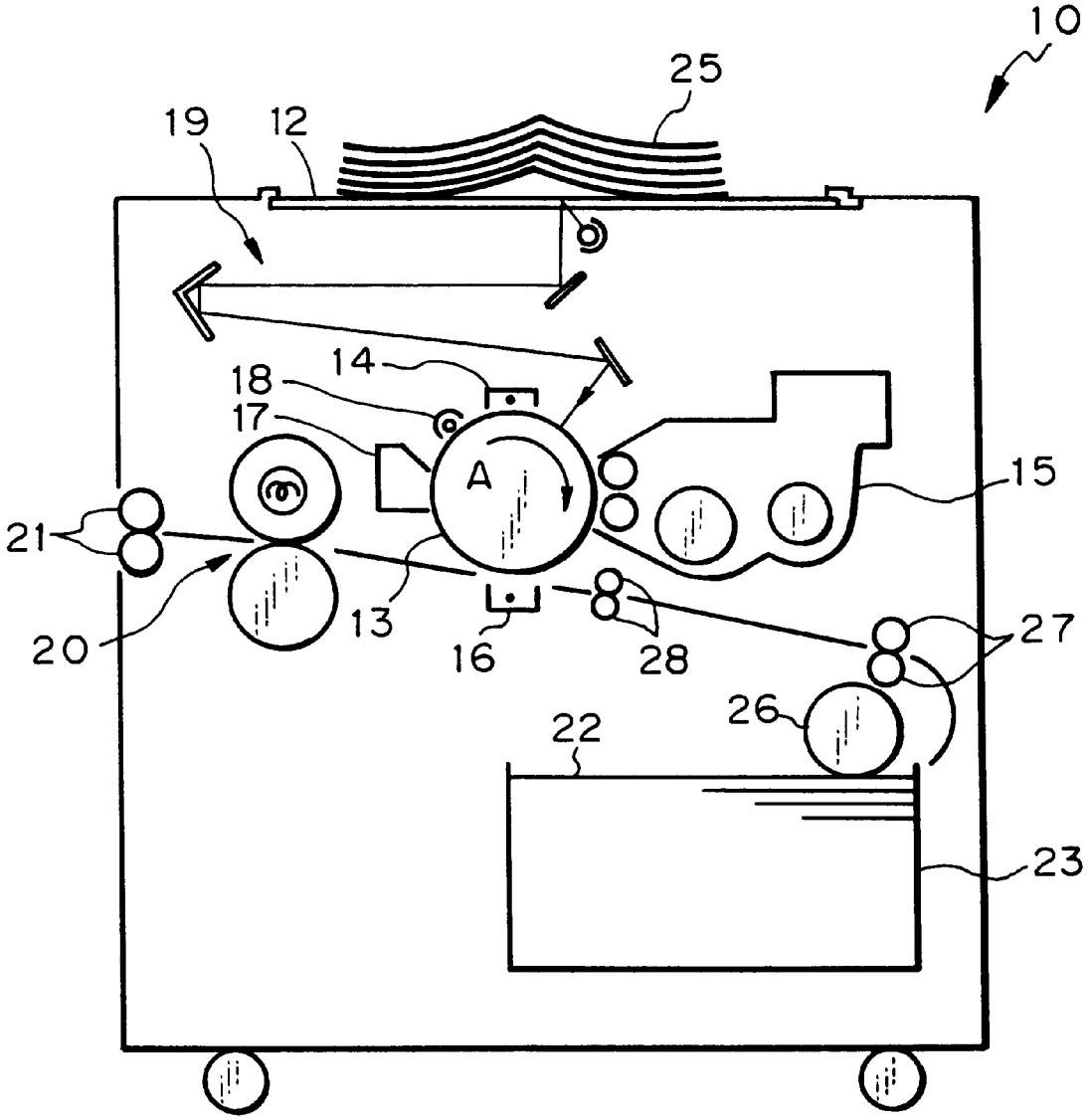
FIG. 1 shows an image forming apparatus to which the present invention is applicable and implemented as a copier by way of example.

First, an image forming apparatus to which preferred embodiments of the toner container in accordance with the present invention are applicable will be described with reference to FIG. 1. As shown, the image forming apparatus is implemented as an electrophotographic copier by way of example. The copier includes a body 10 and a glass platen 12 mounted on the top of the body 10. Let the viewer's side of FIG. 1 be referred to as the front side hereinafter. A photoconductive element in the form of a drum 13 is disposed in and located substantially at the center of the body 10. A charger 14, a developing unit 15, an image transfer unit 16, a cleaning unit 17 and a discharger 18 are sequentially arranged in this order in a direction A in which the drum 13 is rotatable. An optical writing device 19 is arranged above the charger 14 and discharger 18. A fixing unit 20 and an outlet roller pair 21 are sequentially arranged in this order at the left-hand side of the image transfer unit 16. A mass paper feed unit 23 is loaded with a great amount of papers 22 and removably mounted below the developing unit 15 and image transfer unit 16.

To copy a document, the operator of the copier turns on a power switch, not shown, provided on the body 10, opens a cover plate, not shown, sets the document on the glass platen 12, closes the cover plate onto the document, and then presses a start button, not shown, also provided on the body 10. In response, a pick up roller 26 is caused to rotate and pay out the top paper 22 from the paper feed unit 23. The paper 22 is conveyed by a conveyor roller pair 27 until it has been stopped by a registration roller pair 28. This prevents the paper 22 from being conveyed askew.

On the other hand, the drum 13 rotating in the direction A has its surface charged by the cheer 14. The optical writing device 19 illuminates the charged surface of the drum 13 imagewise and thereby forms an electrostatic latent image representative of the document image thereon. The developing unit 15 deposits toner on the latent image so as to transform it to a corresponding toner image. The registration roller pair 28 drives the paper 22 toward the drum 13 such that the leading edge of the paper 22 meets the leading edge of the toner image formed on the drum 13. The image transfer unit 16 transfers the toner image from the drum 13 to the paper 22. After the image transfer, the cleaning unit 17 cleans the surface of the drum 13, and then the discharger 18 discharges the cleaned surface of the drum 13.

The paper 22 carrying the toner image thereon is conveyed to the fixing unit 20 and has the toner image fixed thereby. The paper 22 coming out of the fixing unit 20 is driven out onto a tray, not shown, by the outlet roller pair 21.

Figure 2:
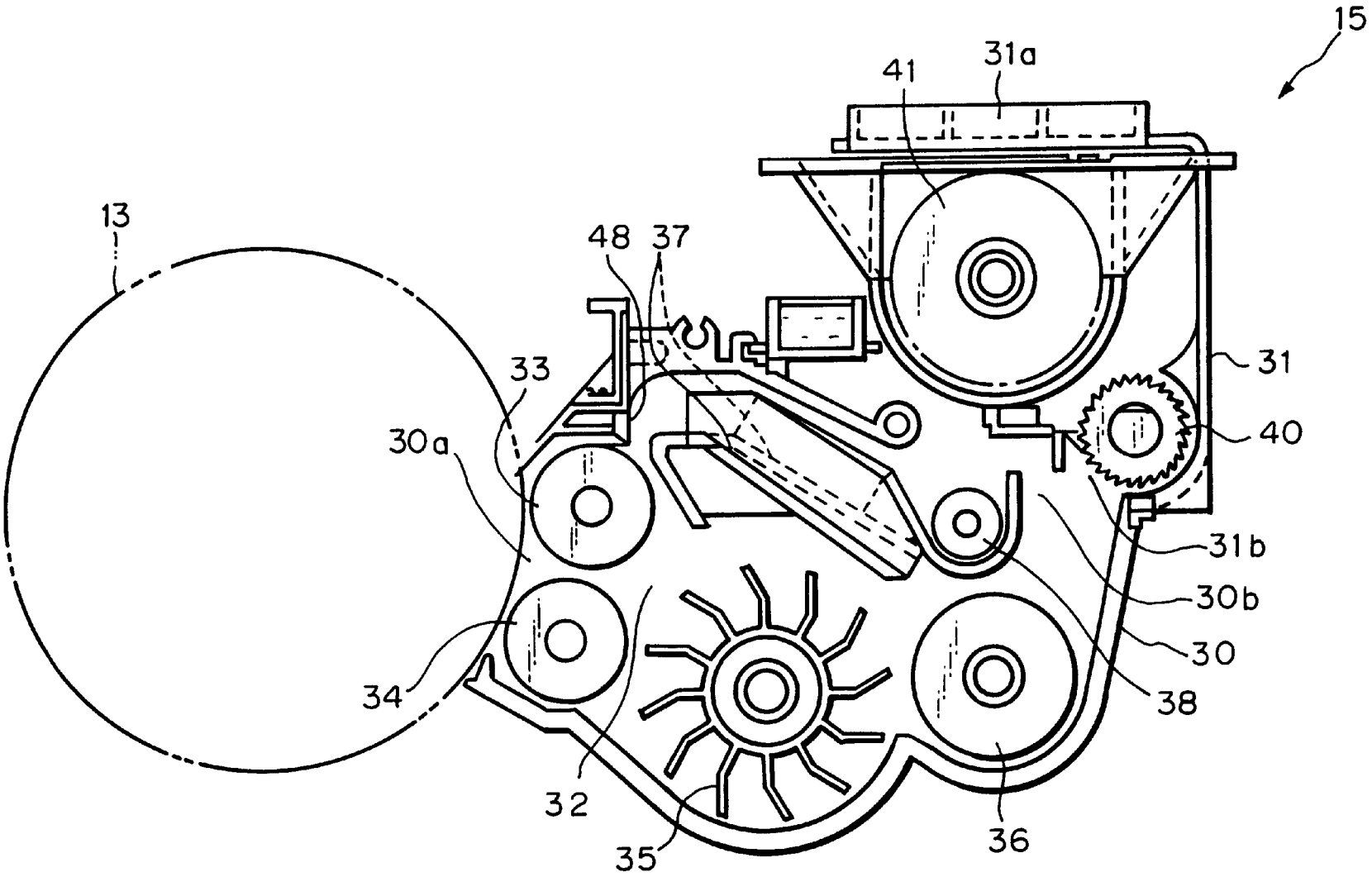
FIG. 2 is a section of a developing device included in the copier of FIG. 1.

As shown in FIG. 2, the developing unit 15 has a casing or tank 30 and a toner hopper 31. The developing unit 15 extends in the axial direction of the drum 13 and forms a developing chamber 32. The developing chamber 32 faces the drum 13 via an opening 30*a* formed in the left portion of the casing 30, as seen in FIG. 2, and is communicated to the toner hopper 31 via an opening 30*b* formed in the right portion of the casing 30. An upper and a lower developing roller 33 and 34, respectively, are disposed in the developing chamber 32 in the vicinity of the opening 30*a*. A paddle 35 and a mixing roller 36 are sequentially arranged in this order from the side adjoining the rollers 33 and 34 toward the side adjoining the opening 30*b*. A separator 37 and an agitator/conveyor screw 38 arm disposed above the paddle 35 and mixing roller 36.

The toner hopper 31, Like the casing 30, extends in the axial direction of the drum 13. The toner hopper 31 has a toner inlet 31*a*at its top and a toner outlet 31*b* at its bottom, The toner outlet 31*b* is positioned above the opening 30*b* of the casing 30. A toner replenishing roller 40 is disposed in the toner hopper 31 in such a manner as to block the toner outlet 31*b*. A plurality of axial grooves are formed in the circumferential surface of the toner replenishing roller 40. The roller 40 is journalled to opposite side walls of the toner hopper 31 and caused to rotate by a motor, not shown. A conveyor screw 41 is also disposed in the toner hopper 31 and journalled to the opposite side walls of the toner hopper 31. The conveyor screw 41 is also driven by a motor, not shown.

Figure 3:
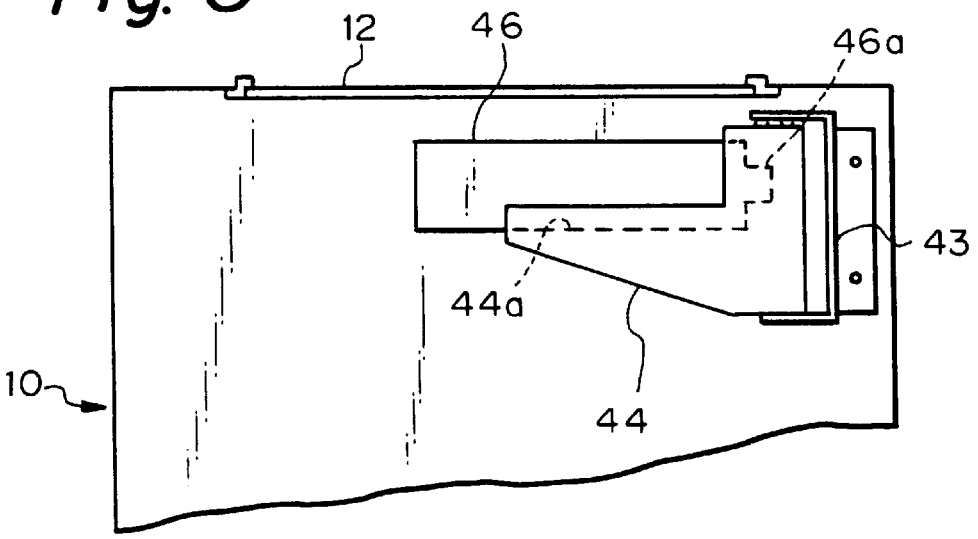
FIGS. 3 and 4 show the configuration of a rack also included in the copier of FIG. 1 and used to support a toner container.
Figure 4:
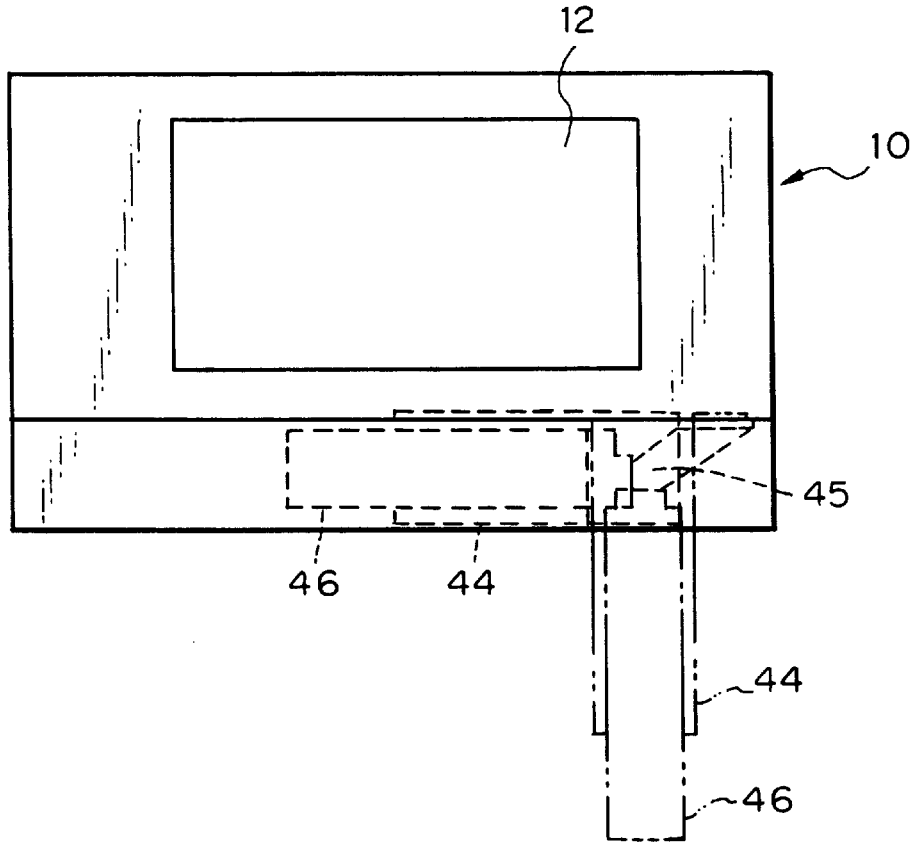

As shown in FIG. 3, a bracket 43 is fastened to the inner periphery of the upper front portion of the body 10 by screws. A rack 44 for mounting a toner container 46 is affixed to the bracket 43. The rack 44 includes a seat portion 44*a* for laying the toner container 46 sideways. The seat portion 44*a* has a clamp opening for clamping the toner outlet or mouth 46*a* of the toner container 46 at its right portion, as seen in FIG. 3. The clamp opening is fluidly communicated to a toner drop path also formed in the seat portion 44*a*. A drive transmission mechanism for connecting the toner container 46 to a motor, not shown, is built in the rack 44. As shown in FIG. 4, the rack 44 is supported by a shaft 45 at its upper and lower ends and rotatable about the shaft 45 between a position indicated by a dashed line and a position indicated by a dash-and-dots line in the horizontal direction. The dashed line position is parallel to the front of the body 10 while the dash-and-dots line position is perpendicular to the front of the body 10.

1st Embodiment

Figure 5A:
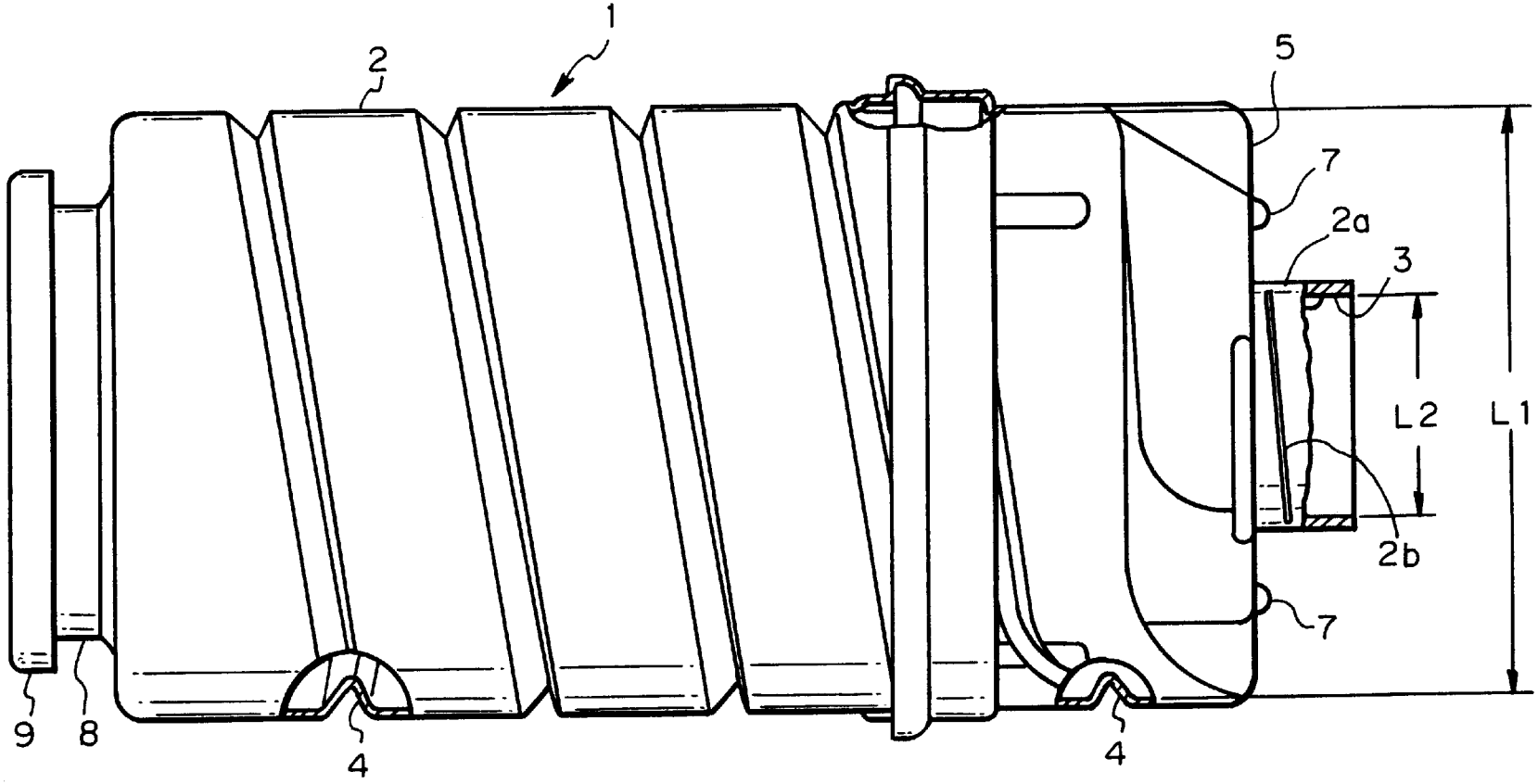
FIGS. 5A and 5B show a first embodiment of a recyclable toner container in accordance with the present invention.
Figure 5B:
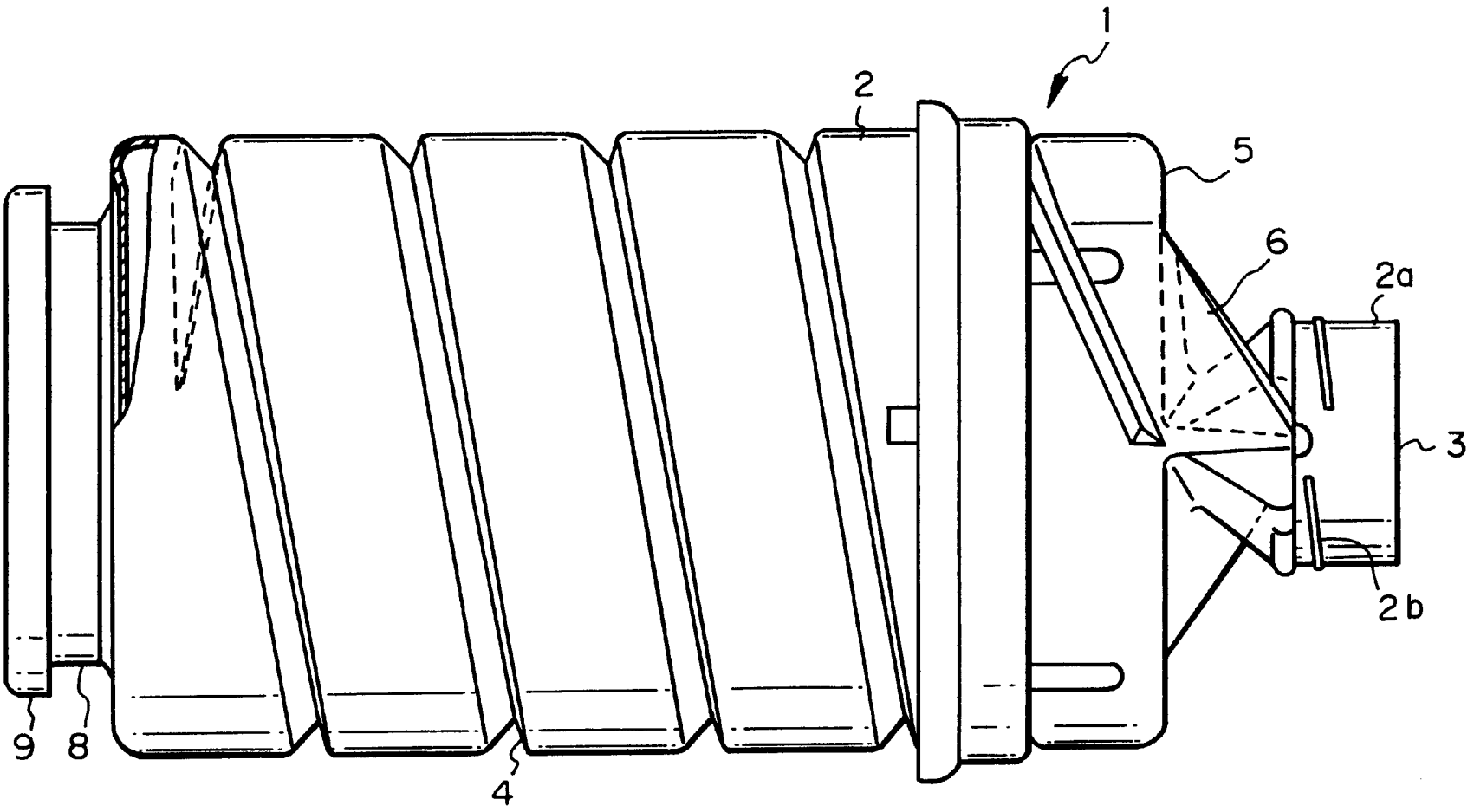

This embodiment implements a recyclable toner container capable of solving the previously stated problem (1). The toner container is shown in a front view and a side elevation in FIGS. 5A and 5B, respectively. As shown, the toner container, generally 1, has a hollow cylindrical container body 2 and a collar 2*a* protruding from the center of one end of the container body 2. A toner outlet or mouth 3 is formed in the collar 2*a*. The axis of the container body 2 and that of the toner outlet 3 are aligned with each other. A spiral ridge 4 is formed in the inner circumferential surface of the container body 2, i.e., protrudes toward the axis of the container body 2. When the container 1 is rotated about its axis, toner stored therein is sequentially driven toward the toner outlet 3 along the spiral ridge 4. Because the toner outlet 3 is positioned at the center of the container body 2 and has a diameter L2 smaller than the diameter L1 of the container body 2, it is necessary to raise the toner to the outlet 3. For this purpose, in the illustrative embodiment, the container body 2 is provided with two shoulder portions 5 in the vicinity of the toner outlet 3. Two bulge portions 6 for raising the toner each extends from the circumference of the container body 2 to one of the two shoulder portions 5. Lugs 7 are formed on the top of the shoulder portions 5. The lugs 7 are engageable with a gearing, not shown, driven by a drive arrangement, not shown. In. this condition, the container 1 is rotatable about its own axis. A ridge 2*b* is formed on. the outer periphery of the collar 2*a* in order to reduce the deformation of th toner outlet 3. The ridge 2*b* may be implemented by a separate member wround around the collar 2*a* or may be molded integrally with the collar 2*a*. A plurality of such ridges 2*b* may be provided on the collar 2*a*, if desired.

The container 1 is formed by, e.g., blow molding hard polyethylene and can be recycled.

Figure 6:
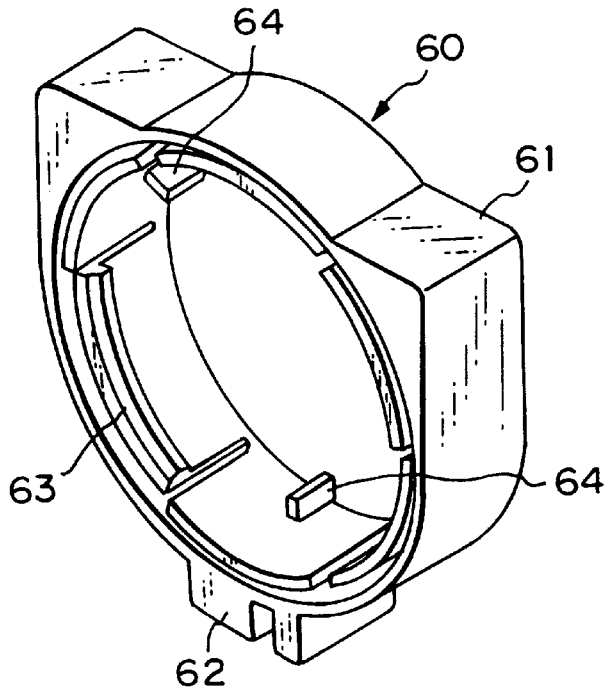
FIG. 6 is a perspective view of an unreplaceable member to be fitted on the container shown in FIGS. 5A and 5B.
Figure 7:
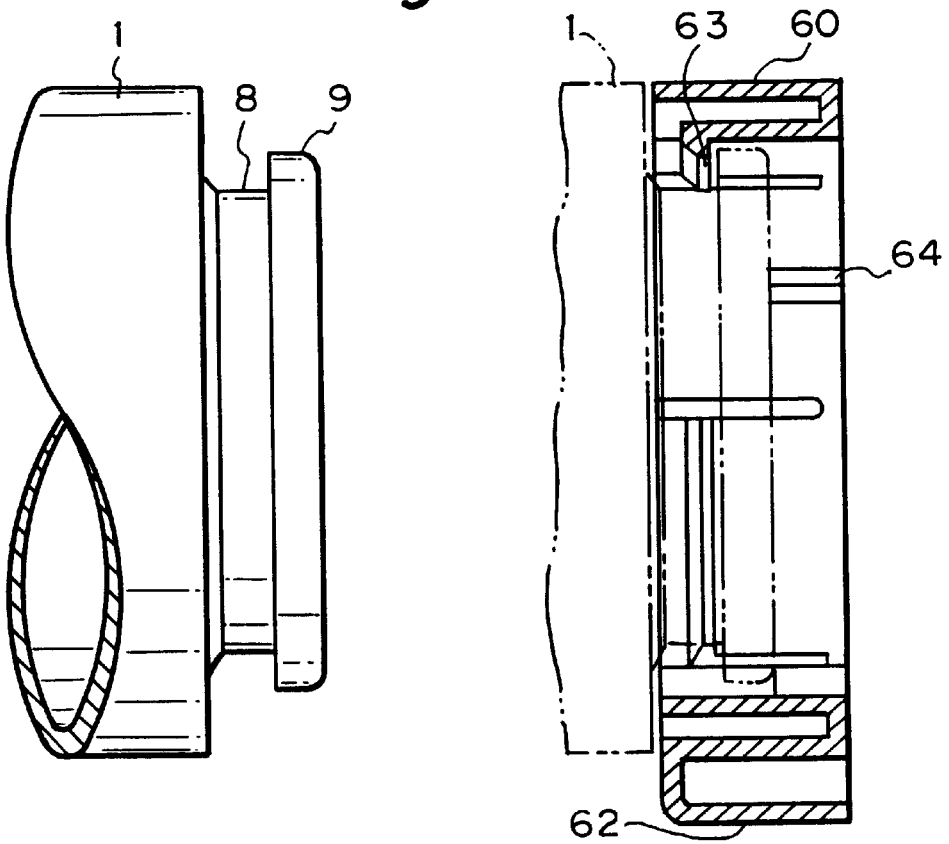
FIG. 7 shows how the unreplaceable member is mounted to the container.

A circumferential lock groove 8 is formed in the outer periphery of the bottom portion of the container body 2. A flange-like projection 9 is contiguous with the lock groove 8. FIGS. 6 and 7 show an annular unreplaceable member 60. The unreplaceable member 60 is removably received in the lock groove 8. This member 60 plays the role of identifying means for preventing toner of unexpected kind from being replenished into the developing unit by accident. As shown in FIGS. 6 and 7, the member 60 has on its outer periphery a double-shoulder protuberance 61 matching with the configuration of a portion for mounting the toner container 1, and a lug 62 whose configuration is representative of a particular kind of toner. Also, the member 60 has on its inner periphery a plurality of (three in the embodiment) ridges 63 and a plurality of (three in the embodiment) stops 64. The ridges 63 are received in the groove 8 for locking the member 60 to the Container body 2. The ridges 63 and stops 64 hold the projection 9 therebetween, The member 60 is also formed of plastics.

Figure 8A:
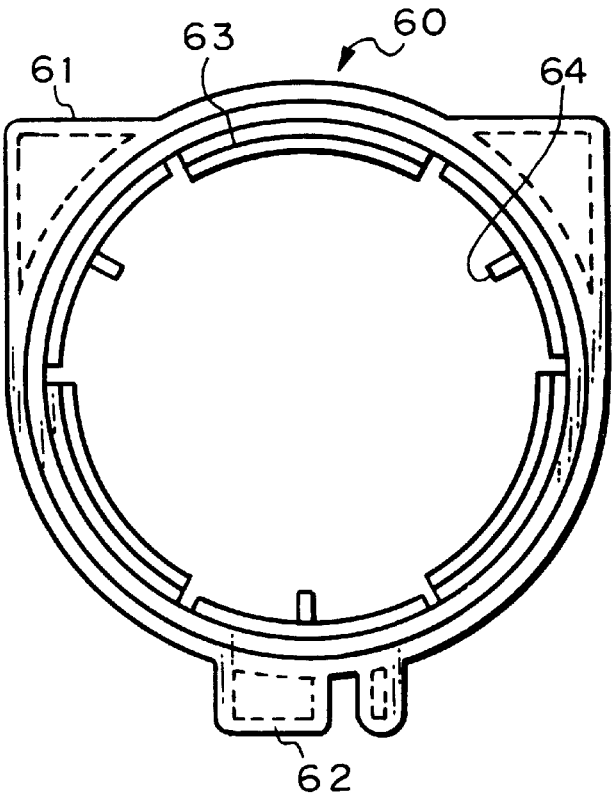
FIG. 8A is a front view showing a specific configuration of the unreplaceable member.
Figure 8B:
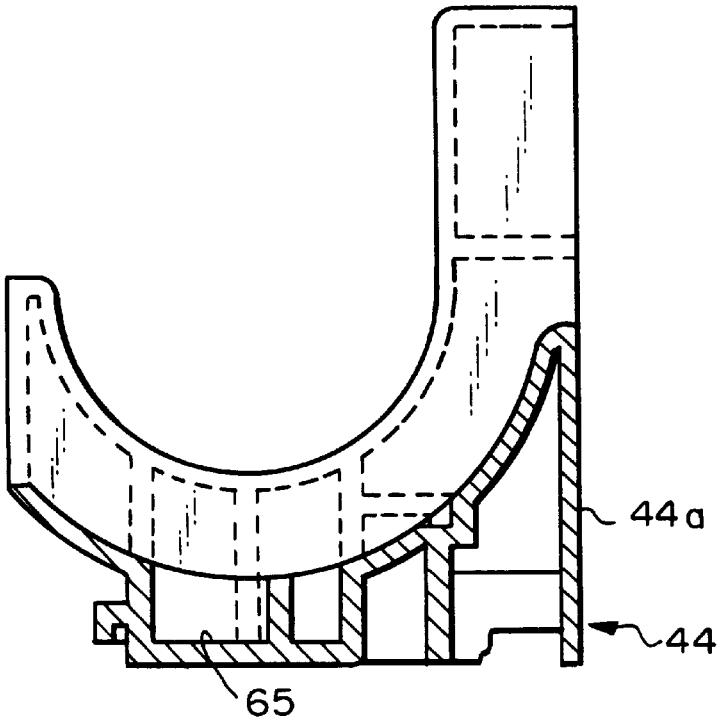
FIG. 8B is a section showing the unreplaceable member of FIG. 8A together with a seat portion included in the rack of the copier.
Figure 9A:
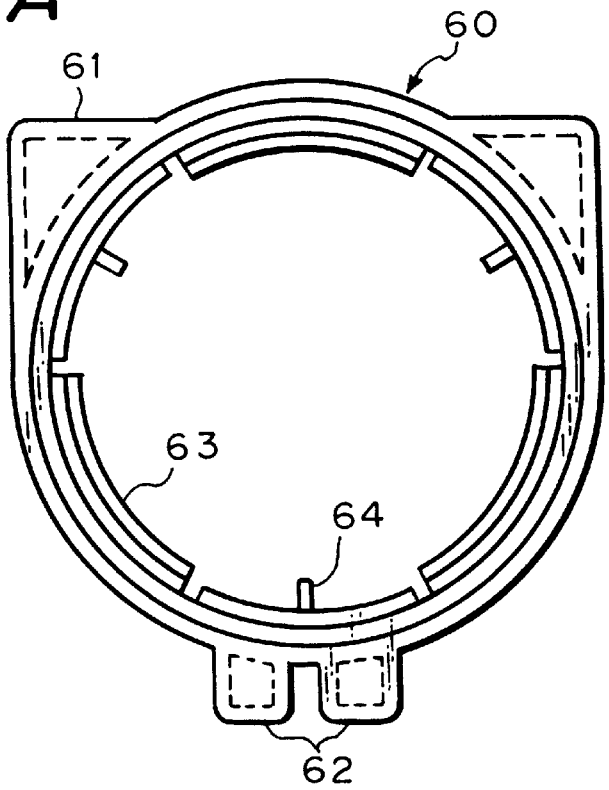
FIG. 9A is a front view showing another specific configuration of the unreplaceable member.
Figure 9B:
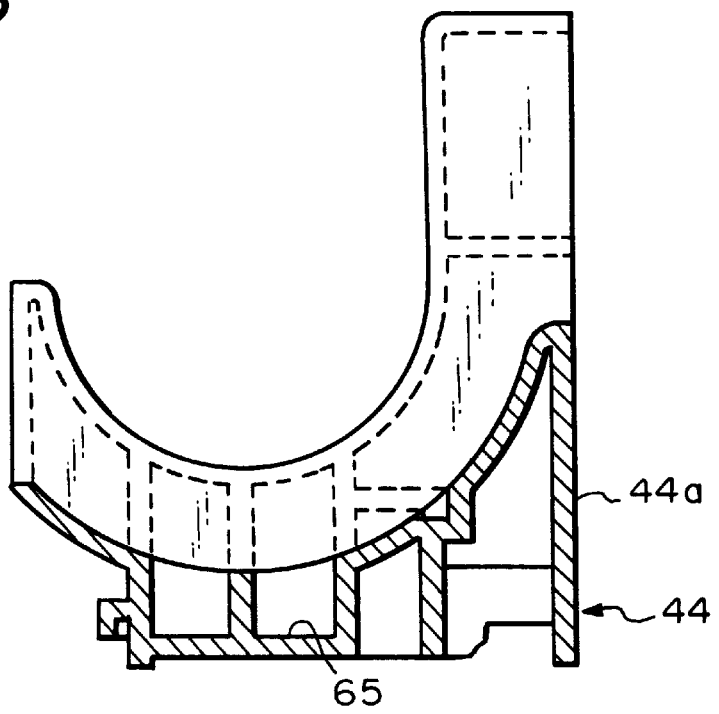
FIG. 9B is a section showing the unreplaceable member of FIG. 9A together with the seat portion included in the rack of the copier.

FIGS 8A and 9A each shows a particular specific configuration of the lug 62 of the unreplaceable member 60 and representative of a particular kind of toner. FIGS. 8B and 9B respectively show recesses 65 formed in the seat portion 44*a* of the rack 44 and respectively fitting for the lugs 62 shown in FIGS. 8A and 9A. In this condition, the rack 44 with the recess 65 shown in FIG. 8B allows only the toner container 1 having the unreplaceable member 60 formed with the recess 65 of FIG. 8A to be mounted thereto. This is also true with the rack 44 with the recess 65 shown in FIG. 9B. As a result, toner of unexpected kind is successfully prevented from being replenished into the developing unit. When the container 1 is set on the seat portion 44*a* of the rack 44, the protuberance 61 cooperates with the seat portion 44*a* to restrict the orientation of the member 60.

In the illustrative embodiment, all the containers 1 have the same structure for mounting the unreplaceable member 60 without regard to the configuration of the lug 62 of the member 60. Therefore, a single kind of containers 1 can be shared by toners each having a particular property. This increases the number of containers 1 which can be collected and therefore efficiently recycled. Further, a circle defined by the edges of the ridges 63 of the member 60 to be received in the groove 8 is greater in diameter than the groove 8, but smaller than the diameter of the projection 9. This, coupled with the fact that the distance between the ridges 63 and the stops 64 is slightly greater than the width of the projection 9, allows the member 60 to freely rotate relative to the toner. container 1 and allows it to be easily attached and detached, as desired Specifically, the member 60 should only be pulled out from the container 1 at the time of recycling and then coupled over the container 1 at the time of reuse. In addition, because the member 60 is freely rotatable relative to the container 1, it does not obstruct the rotation of the container 1.

The unreplaceable member 60 may be implemented as a cap, if desired Also, the lug 62 of the member 60 and the recess 65 of the rack 44 may be replaced with each other. The lug or the recess of the member 60 may even be replaced with a lug or a recess formed in the bottom side of the toner container 1. Specifically, a lid, for example, may be provided on the bottom side of the toner container 1 mounted to the rack 44 and formed with a recess or a lug corresponding to the lug or the recess of the member 60.

As stated above, in the illustrative embodiment, all the toner containers each storing toner of particular kind or particular color are formed of plastics and provided with an identical configuration. An unreplaceable member having a lug whose configuration matches with particular toner is removably mounted to each of such containers. Therefore, copiers each using toner of particular kind can share a single kind of containers. This increases the number of containers which can be recycled and therefore efficiently recycled. Because the unreplaceable member is attached to the bottom portion of each toner container, it is easy to attach and detach.

2nd Embodiment

This embodiment implements a recyclable toner container calable of solving the previously stated problem (2), paricularly a toner container which allows toner remaining therein to be easily removed at the time of recycling. The toner container is shown in a front view and a side elevation in FIGS. 10A and 10B, respectively. This embodiment differs from the first embodiment in that the toner container 1 lack the lock groove 8 and projection 9.

Figure 10A:
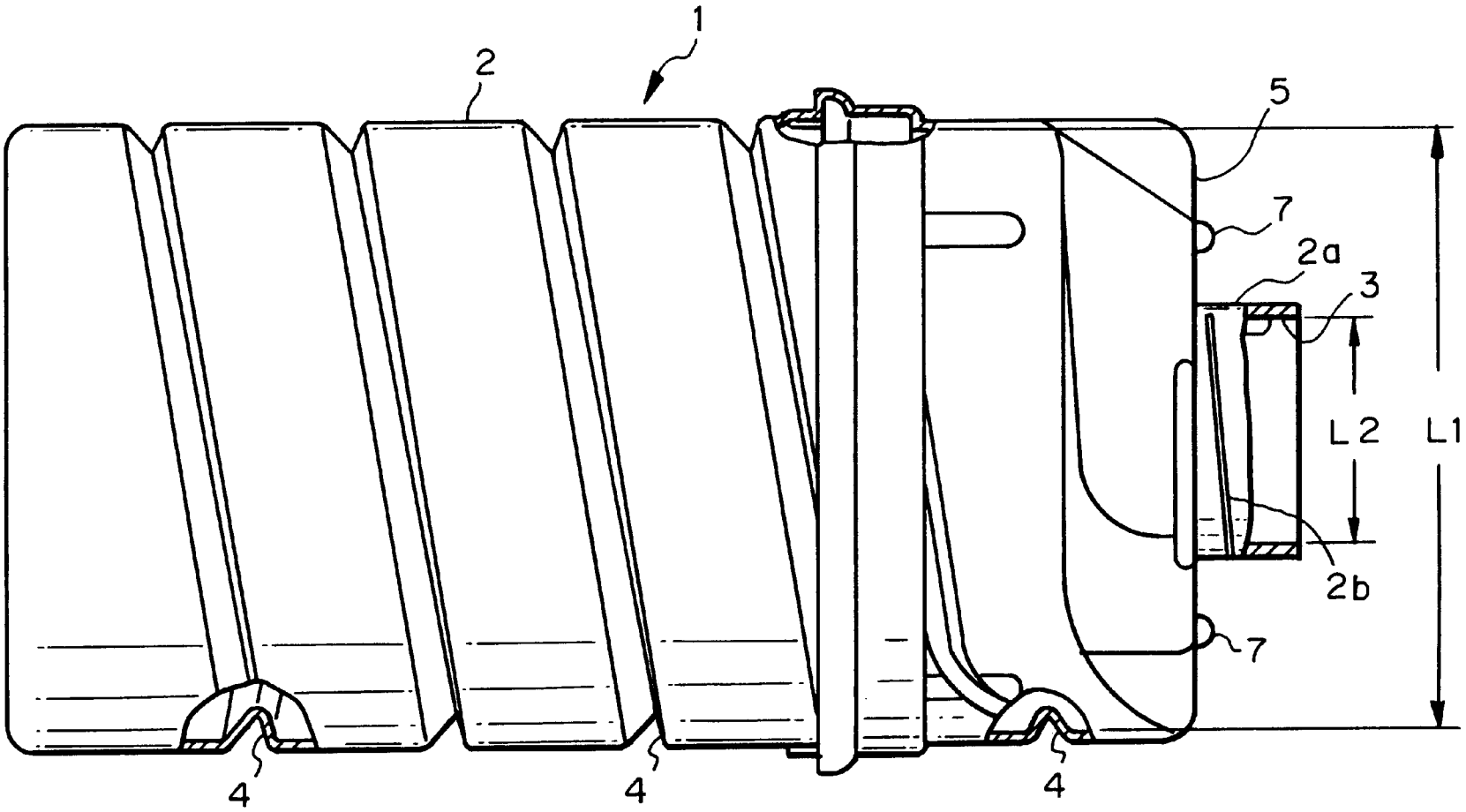
FIGS. 10A and 10B show a second embodiment of the toner container in accordance with the present invention.
Figure 10B:
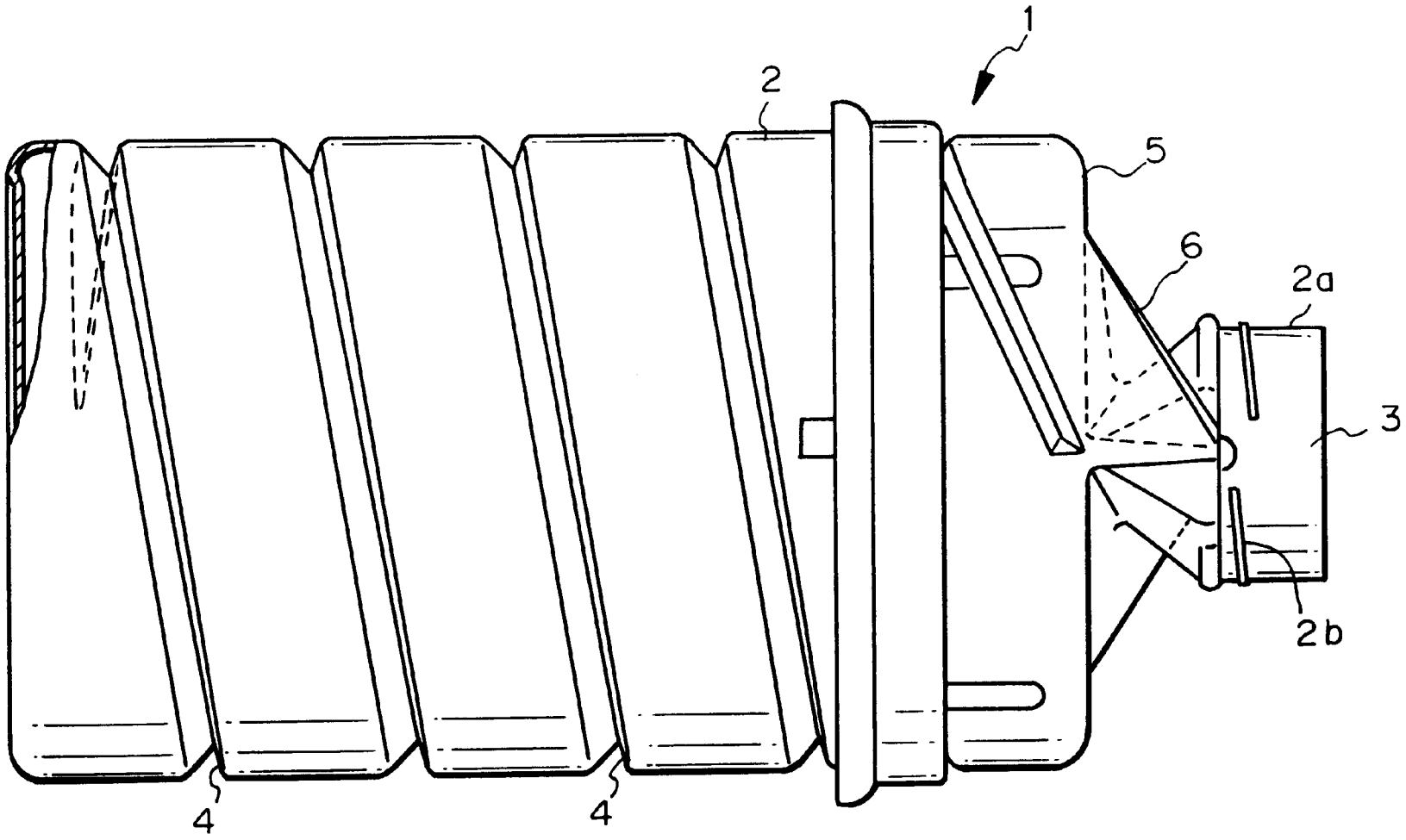
Figure 11:
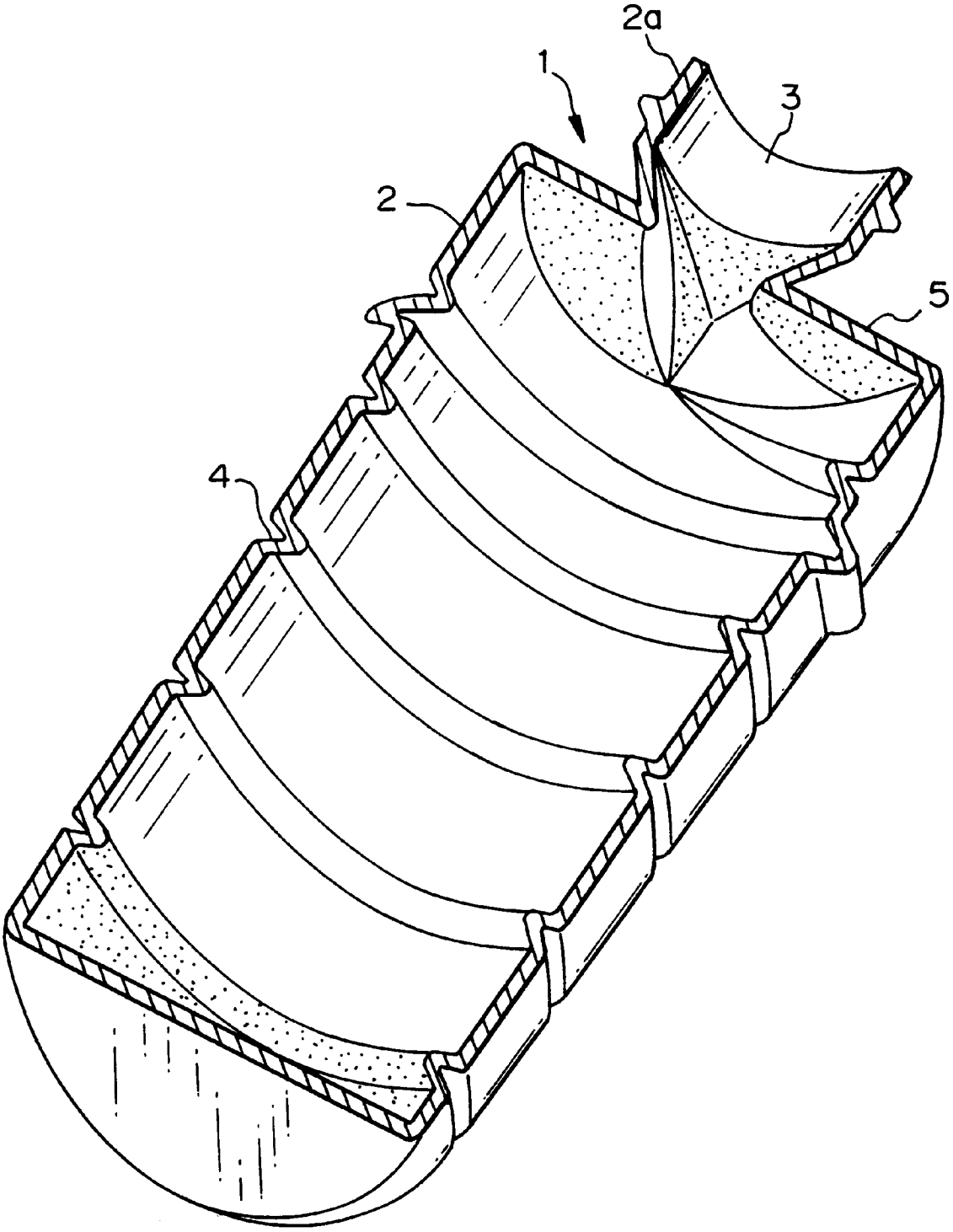
FIG. 11 is a sectional perspective view showing toner remaining on a toner container after cleaning.

When the container 1 shown in FIG. 10A and 10B is recycled, it is necessary to remove toner remaining in the container 1. With a conventional cleaning method, it is difficult to fully remove the remaining toner simply in a short period of time. This is particularly true with toner, remaining in the shoulder portions 5, bulge portions 6 and bottom portion of the container 1, as shown in FIG. 11.

The illustrative embodiment cleans the inside of the container 1 by using air. Specifically, in the first step, a forward jet type nozzle 50 shown in FIG. 12A and a suction nozzle 51 shown in FIG. 12B are used in combination. Then, in the second step, a backward jet type nozzle 52 shown in FIG. 12C and the suction nozzle 51 are used in combination. In the first step, a jet of air sent from the nozzle 50 causes the toner to fly about away from the walls of the toner container 1, and then the nozzle 51 sucks the toner before it again deposits on the container 1. However, the nozzle 50 cannot sufficiently remove the toner from the shoulder portions 5 and bulge portions 6 alone. In the second step, air jetted from the nozzle 52 cause the toner existing in the portions 5 and 6 to fly about, and then the nozzle 51 sucks such toner.

The above cleaning method can remove a substantial part of the toner left in the container 1. However, the cleaning method cannot fully remove the toner left in the fast pitch portion of the spiral, as counted from the bottom of the container 1 and the toner left in the shoulder portions and bulge portions 6, as shown in FIG. 11. In light of this, the illustrative embodiment repeats the two-step cleaning procedure several times, but the number of times of repetition should preferably be minimized. We conducted a series of experiments with various kinds of containers 1 and found that the cleaning ability greatly depends on the configuration of the container 1. Particularly, as for the shoulder portions 5 and bulge porions 6, the cleaning ability is affected by the ratio in diameter between the toner outlet 3 and the container body 2, as also determined by experiments.

Figure 13:
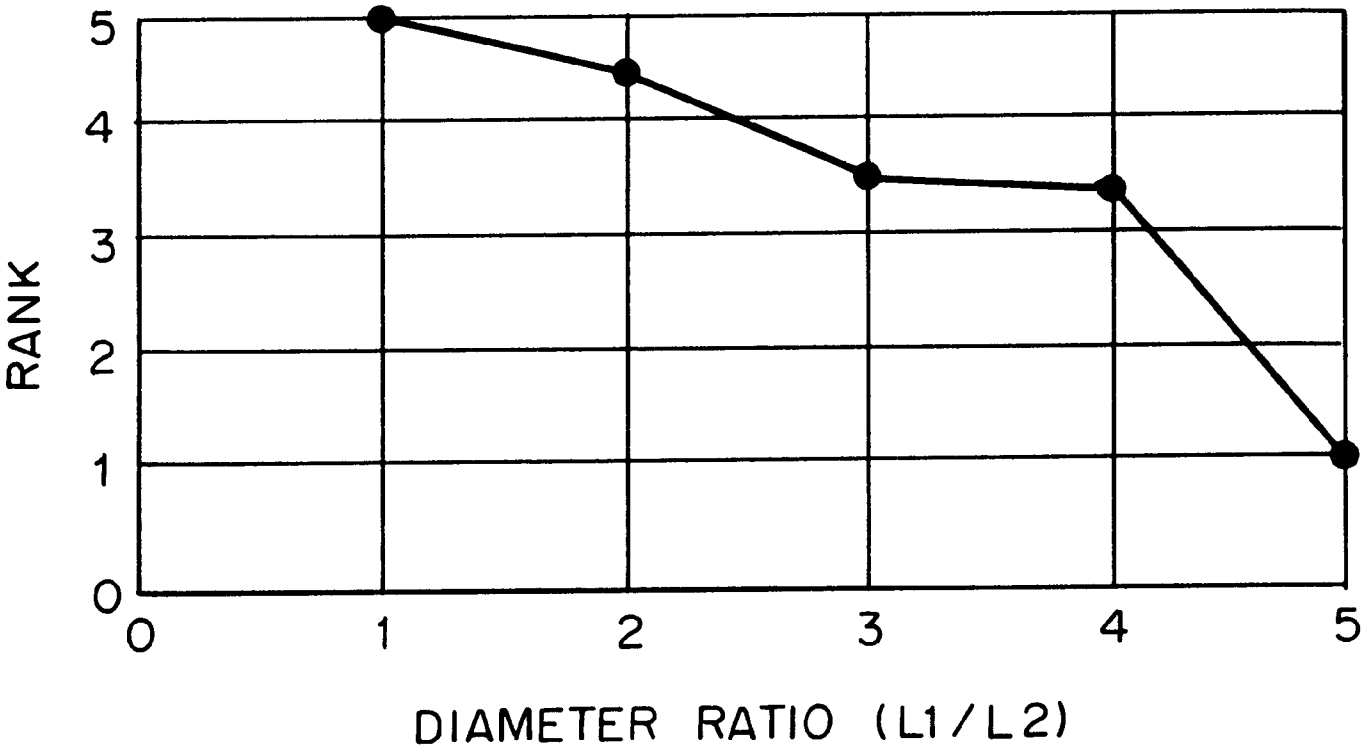
FIG. 13 is a graph showing a relation between the ratio between the diameter of a toner outlet and that of a container body and the ram of cleaning ability.

FIG. 13 is a graph showing a relation between the ratio of the diameter L1 of the container body 2 to the diameter L2 of the toner outlet 3 and the cleaning rank of the portions 5 and 6. The cleaning ability is ranked on the basis of the condition in which the toner remains in the portions 5 and 6 when the toner container 1 is cleaned under preselected conditions. As shown, in rank 5, substantially no toner is left in the portions 5 and 6. In rank 4, an extremely small amount of toner is left in the portions 5 and 6. In rank 3, some toner is left in the portions 5 and 6. In rank 2, a noticeable amount of toner is left in the portions 5 and 6. In rank 1, a critical amount of toner is left in the portions 5 and 6. The cleaning abilities of rank 3 and above were found to reduce the number of times of repetition of the two-step cleaning procedure. Stated another way, the cleaning abilities of below rank 3 increased the required number of times of repetition and degraded the cleaning efficiency, resulting in an increase in cleaning cost.

For the above experiments, use was made of four kinds of containers 1 different in the ratio of the diameter L2 of the toner outlet 3 to the diameter L1 of the container body 2, i.e., having ratios of 1, 2, 3, 4 and 5. As FIG. 13 indicates, the cleaning abilities of rank 3 and above were achieved when the ratio of the diameter L2 to the diameter L1 was up to 1:4, i.e., when the following relation held:

$$L1<(4\times L2)$$

In the above condition, it is possible to remove the toner removing in the container 1 by repeating the two-step cleaning procedure several times.

Of course, the radio of the diameter L2 to the diameter L1 should most preferably be 1:1. However, if the diameters L2 and L1 are the same as each other, an excessive amount of toner will be undesirably replenished from the container 2 via the toner outlet 3. Moreover, when the container 1 should be provided with a certain capacity, a cap for closing the toner outlet 3 will also have its diameter increased and will have to be provided with strict dimensional accuracy.

As stated above, in this embodiment, the diameter L1 of the container body 2 is greater than the diameter L2 of the toner outlet 3, but not greater than four times the diameter L2. This allows the toner left in the shoulder portions 5 and bulge portions 6 of the container 6 to be easily removed. The container 1 can therefore be easily cleaned at a low cost at the time of recycling.

3rd Embodiment

Figure 14:
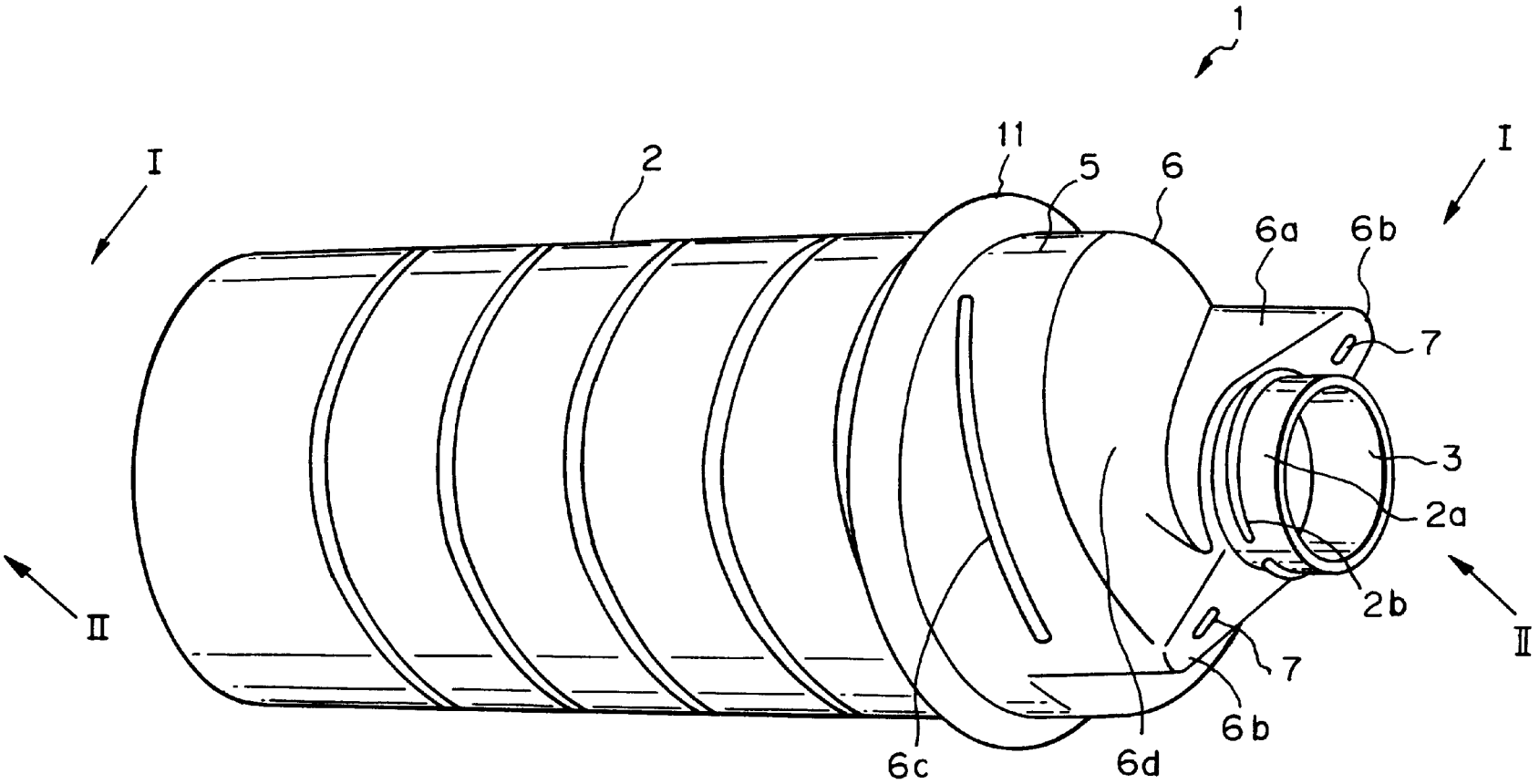
FIG. 14 is a perspective view showing a third embodiment of the toner container in accordance with the present invention.

This embodiment also implements a recyclable toner container capable of solving the problem (2). As shown in FIG. 14, in this embodiment, the hollow cylindrical container body 2 of the toner container 1 also includes the collar 2*a* formed with the toner outlet or mouth 3. The spiral ridge 4 (see FIG. 16) protrudes from the inner periphery of the container body 2 for guiding the toner toward the toner outlet 3, as in any one of the foregoing embodiments or as taught in Japanese Patent Laid-Open Publication No. 60-159769 mentioned earlier. The shoulder portions 5 raise the toner toward the toner outlet 3 in cooperation with the bulge portions 6. The bulge portions 6 each has a side wall 6*a* and an end wall 6*b* which are spaced from the side wall 6*a* and end wall 6*b* of the other bulge portion 6 by 180 degrees with respect to the rotation of the toner container 1. The bulge portions 6 are engageable with the engaging portion of toner container drive means, not shown. The lugs 7 protrude from the end walls 6*b* of the bulge portions 6 in order to insure the engagement of the bulge portions and the engaging portion of the drive means. An annular flange 11 intervenes between the container body 2 and the bulge portions 6. When the above drive means is engaged with the container 1 in such a manner as to surround the bulge portions 6, the flange 11 contact the end face of the drive means so as to restrict the position of the container 1 relative to the drive means.

A guide groove 6*c* is formed in the outer circumferential surface of each bulge portion 6 for guiding the toner toward a space defined by the associated side wall 6*a* and end wall 6*b* while the toner container 1 is in rotation. The guide groove 6*c*, like the spiral groove 4, forms a ridge protruding toward the axis of the container body 2. Each bulge portion 6 additionally includes a slope 6*d* adjoining the end wall of the portion 6 and extending substantially perpendicular to the associated guide groove 6*c* and generally perpendicular to the side wall 6*a*.

Because the two bulge portions 6 each has the various surface, stated above, the toner is guided toward the toner outlet 3 along the bulge portions 6 twice during a single rotation of the toner container 1. Of course, a single bulge portion or three or more bulge portions may be formed in order guide the toner toward the toner outlet 3 only once or three or more consecutive times, as desired.

Figure 15:
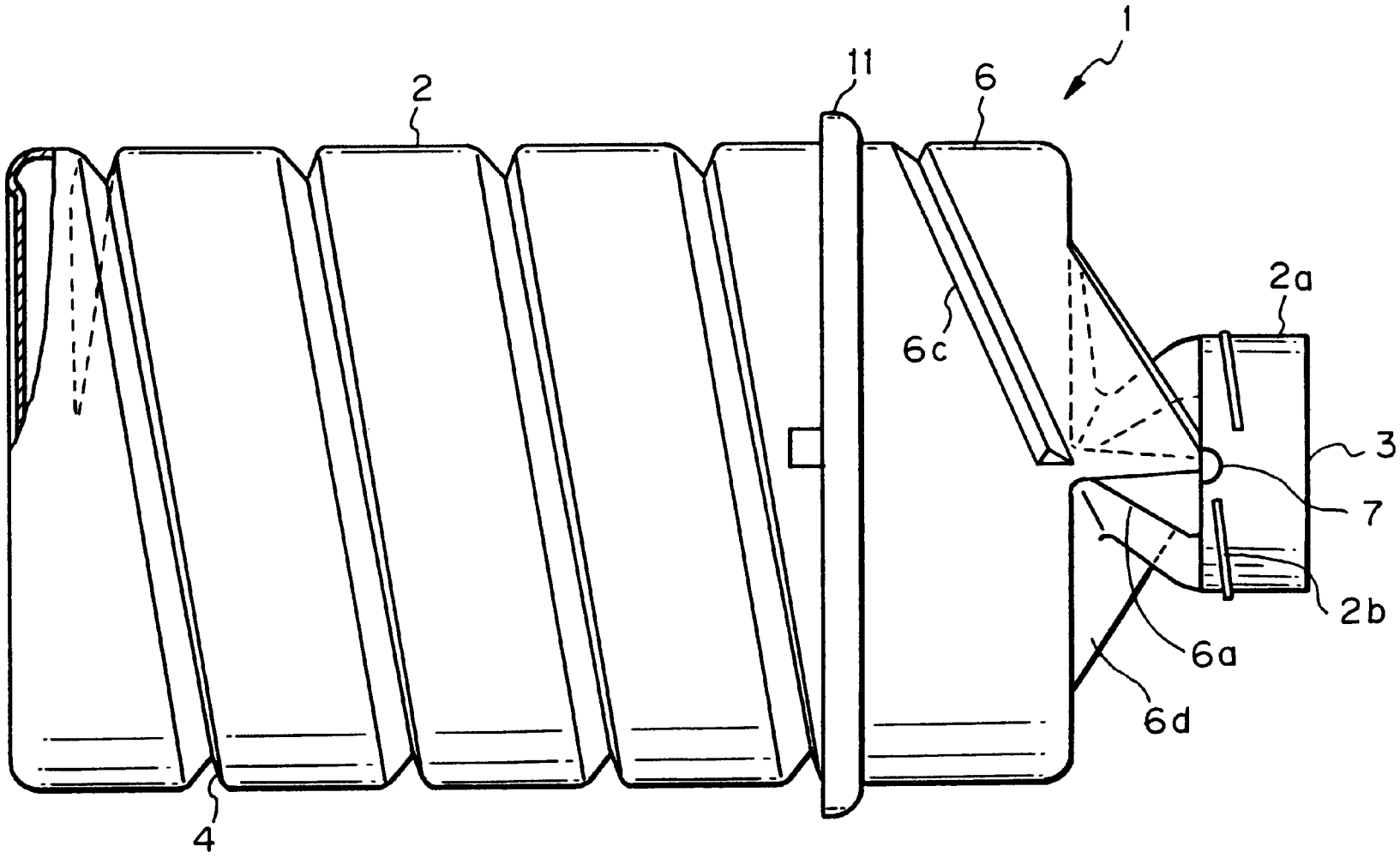
FIG. 15 is a side elevation as seen in a direction I shown in FIG. 14.
Figure 16:
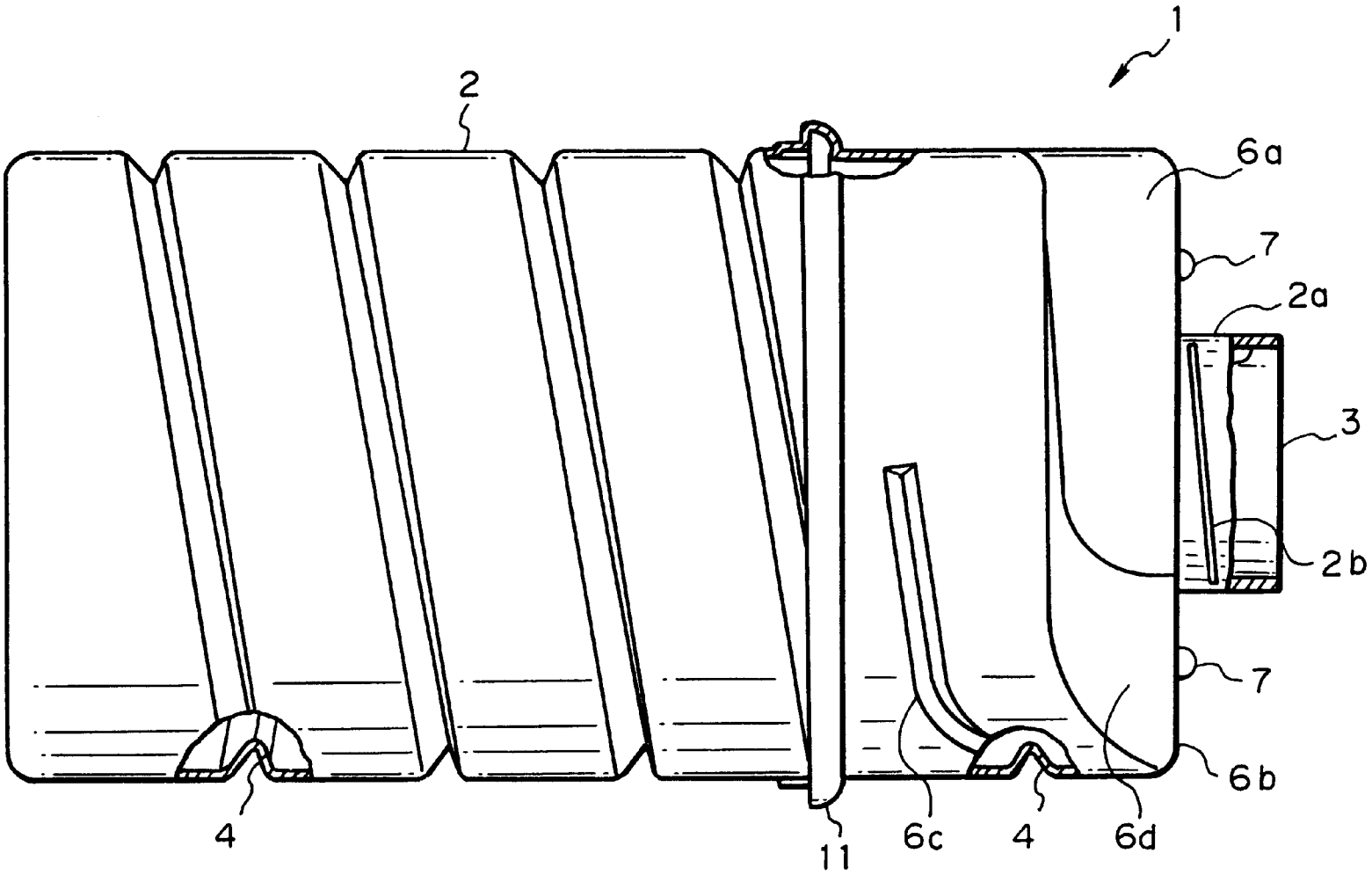
FIG. 16 is a side elevation as seen in a direction II shown in FIG. 14.

FIGS. 15 and 16 are views respectively seen in directions I and II shown in FIG. 14. As shown, the maximum angle between inner periphery of the toner outlet 3 and each bulge portion 6 constituting the shoulder 5, particularly the inner periphery of the end wall 6*b*, is 90 degrees at most; preferably the end wall 6*b* is slightly inclined toward the container body 2. The portion. where the end wall 6*b* merges into the bulge portion 6 is noticeably rounded. Further, the slope 6*d* and other surfaces of the bulge portion 6 each is slightly inclined. In addition, the various surfaces of the bulge portion 6 are arranged such that their boundaries are inclined, and each boundary has a greater curvature than the spiral ridge 4. This kind of configuration allows a minimum of toner to stay in the shoulder portions 5. Thus, the entire shoulder portions 5 are inclined in order to promote the smooth flow of a cleaning fluid, thereby enhancing the efficient cleaning of the container 1.

Figure 12A:
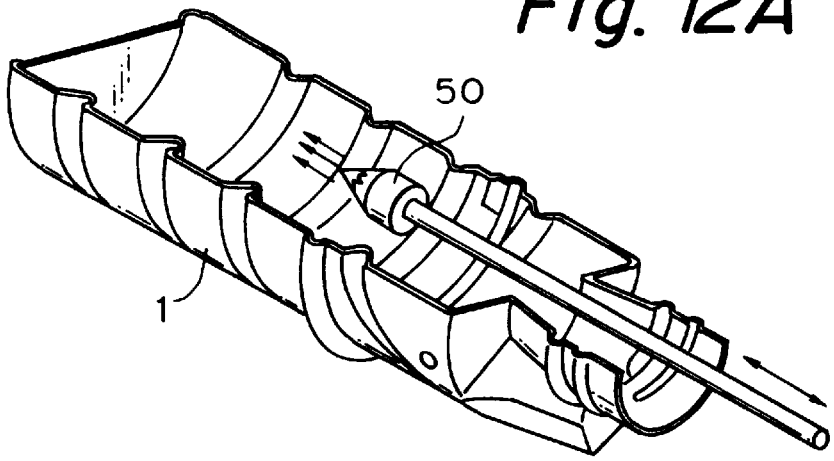
FIGS. 12A–12C are sectional perspective views showing a specific procedure for cleaning the container and using air.
Figure 12B:
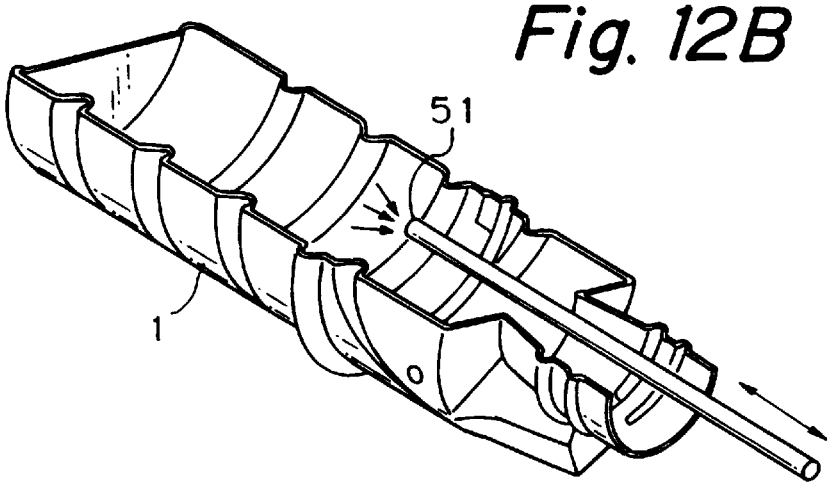
Figure 12C:
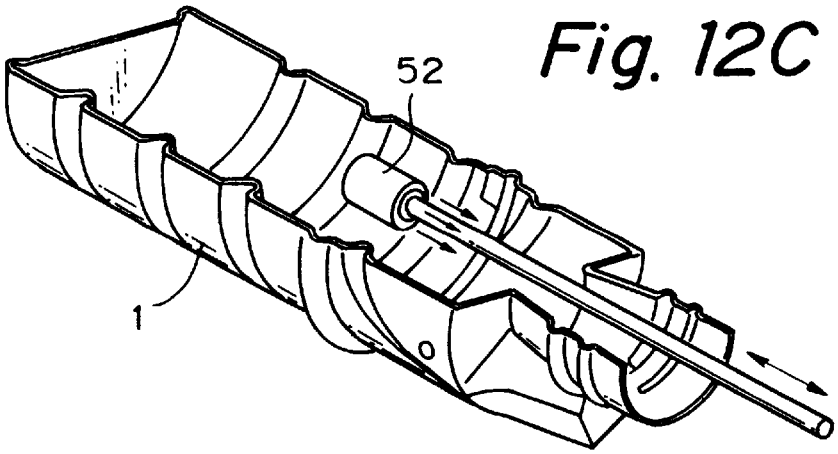

The cleaning method using air, as described with reference to FIGS. 12A–12C, is advantageously applicable to the above toner container 1.

4th Embodiment

Figure 17:
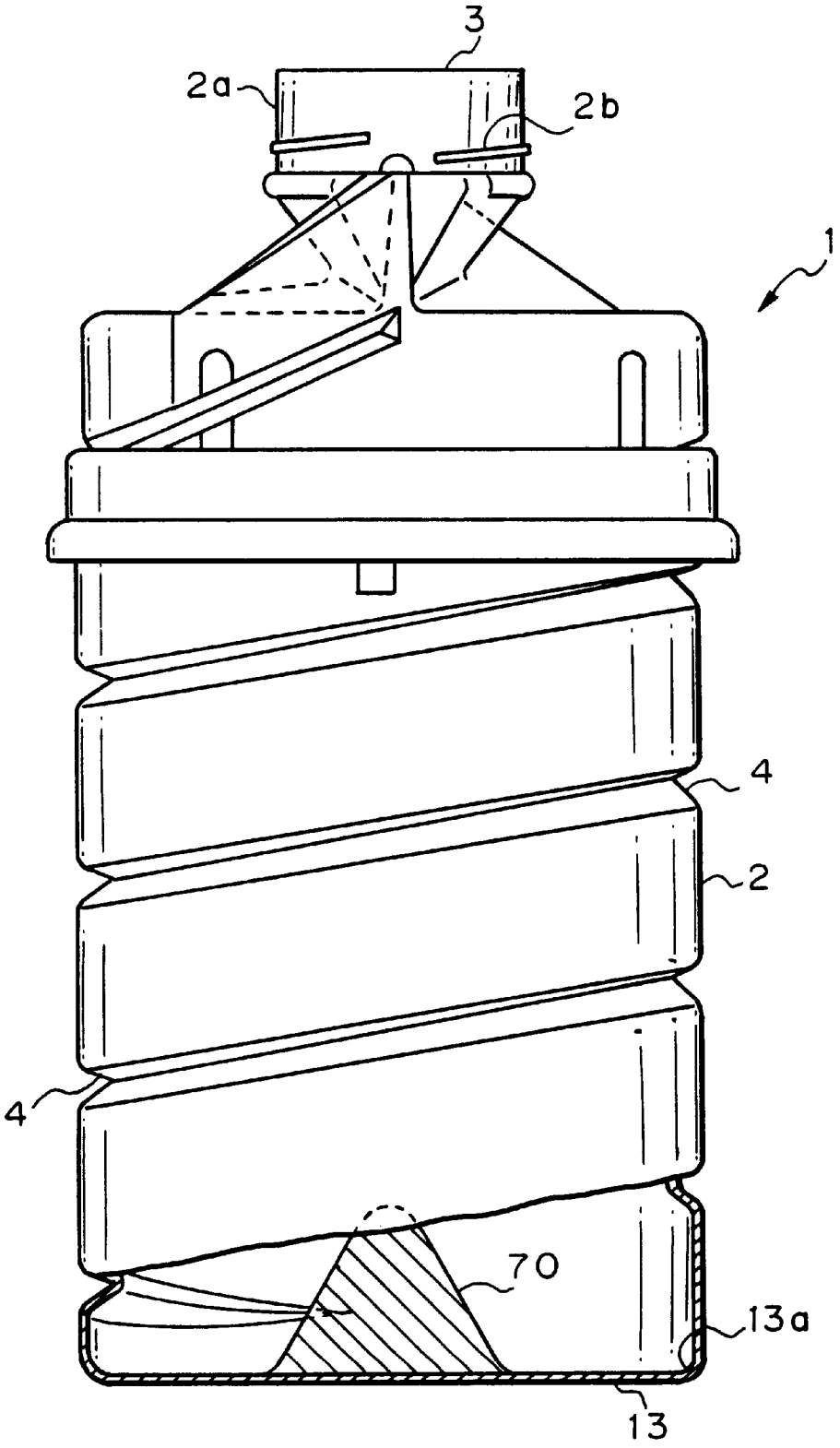
FIG. 17 shows a fourth embodiment of the toner container in accordance with the present invention.

This embodiment also implements a recyclable toner container capable of solving the problem (2) stated earlier. As shown in FIG. 17, the hollow cylindrical container body 2 of the toner container 1 also includes the collar 2*a* formed with the toner outlet or mouth 3. The spiral ridge 4 (see FIG. 16) protrudes from the inner periphery of the container body 2. for guiding the toner toward the toner outlet 3, as in any one of the foregoing embodiments or as taught in Japanese Patent Laid-Open Publication No. 60-159769 mentioned earlier. The container 1 is formed by, e.g., blow molding hard polythylene and can be sufficiently recycled.

The cleaning method described with reference to FIGS. 12A–12C is also applicable to this embodiment. However, the cleaning scheme using air causes the toner to remain in some portions of the toner container 1, particularly the first one pitch portion of the spiral ridge 4 as counted from the comer 13*a* of the bottom 13. We conducted a series of experiments in order to see why the toner in the above first pitch portion is difficult to remove. The experiments showed that because the air jetted forward from the nozzle 50, FIG. 12A, is substantially perpendicularly reflected and returned from the bottom 13, the amount of a to reach the corner 13*a* of the bottom 13 and the one pitch portion contiguous therewith is short.

Figure 18:
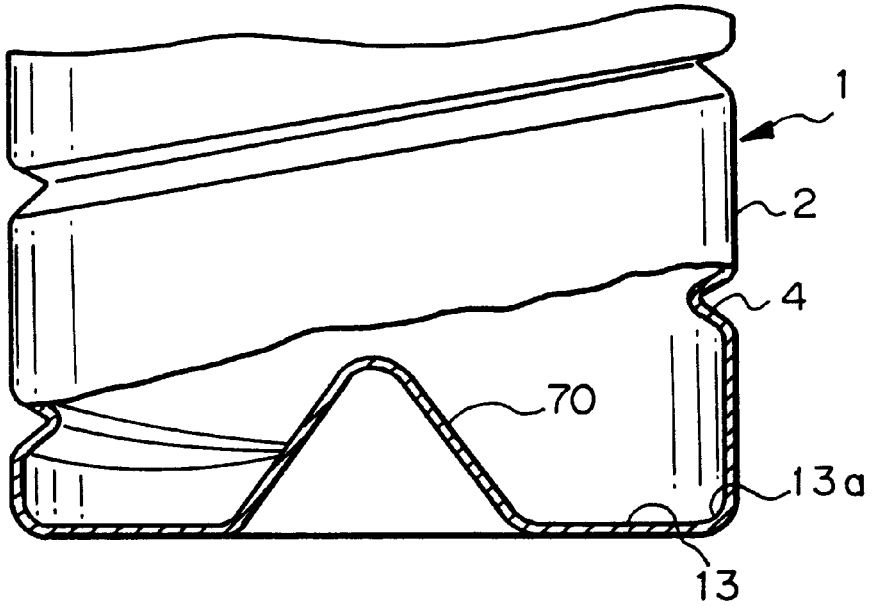
FIG. 18 is a section showing a modification of the fourth embodiment.

The illustrative embodiment includes redirecting means for scattering the air jetted toward the bottom 13 of the container 1. The redirecting means is implemented as a projection 70 projecting into the container 1. As shown in FIG. 17, the projection 70 may be implemented as a substantially conical member provided on the bottom 13. Alternatively, as shown in FIG. 18, the bottom 13 may be caused to protrude into the container 1 in a conical configuration when the container 1 is molded. The projection 70 shown in FIG. 17 may be formed integrally with the container 1 or may be formed by adhering or otherwise affixing a separate member to the container 1.

When air is jetted from the nozzle 50 toward the bottom 13, the projection 70 scatters it in various directions. As a result, air evenly flows to the corner 13*a* of the bottom 13 and therefrom to the one pitch portion of the ridge 4. This noticeably reduces the amount of toner to remain in the corner 13*a* and one pitch portion and thereby reduces the required number of times of cleaning, i.e., promotes efficient cleaning.

Figure 19:
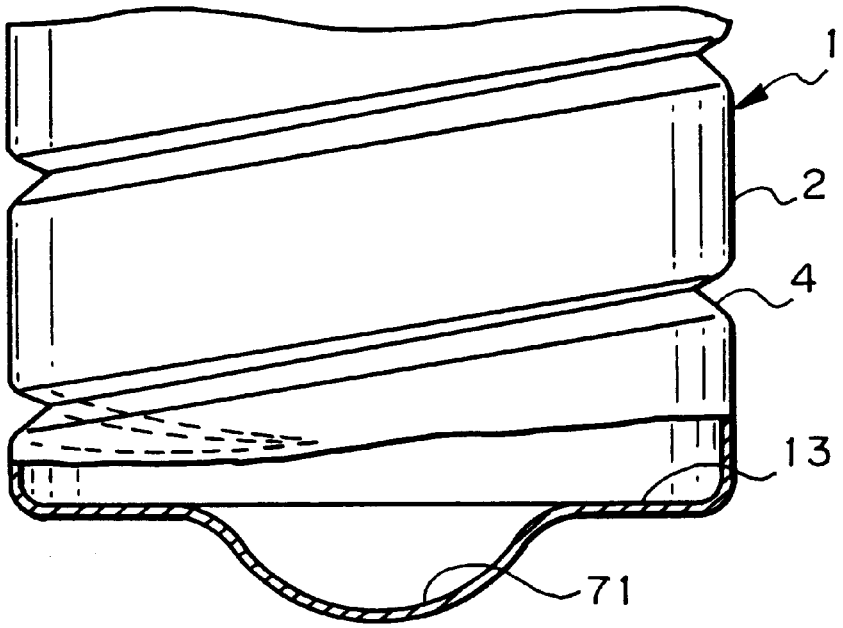
FIG. 19 is a section showing another modification of the fourth embodiment.

FIG. 19 shows a modified form of this embodiment. As shown, the bottom 13 is formed with a recess 71 playing the role of the redirecting means. With the recess 71. it is also possible to scatter air ejected toward the bottom 13 and cause it to reach the corner 13*a* of the bottom 13 and one pitch portion contiguous therewith.

The recess 71 of the bottom 13 shown in FIG. 19 is a projection when seen from the outside of the container 1. The bottom 13 with such a projection is unstable at the time of cleaning or test. Specifically, during cleaning or test, the container 1 must be held in its upright position by support means, not shown. However, the projection 71 of the bottom 13 renders the container 1 unstable. Even the container 1 with the projection 70 is unstable when it is provided with a relatively great length and a relatively small diameter.

Figure 20:
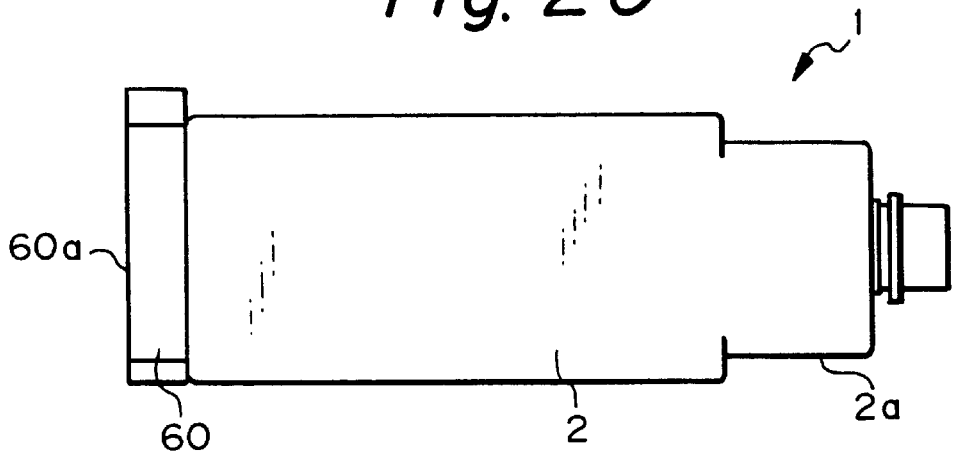
FIG. 20 shows a toner container with an unreplaceable member.
Figure 21:
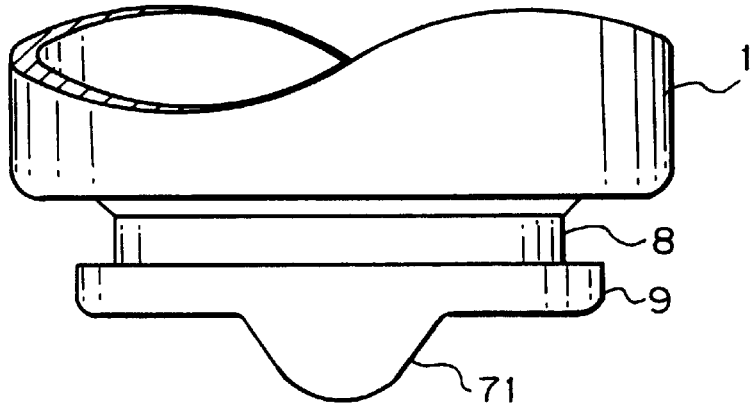
FIG. 21 shows how an unreplaceable member is fitted on a toner container.
Figure 21:
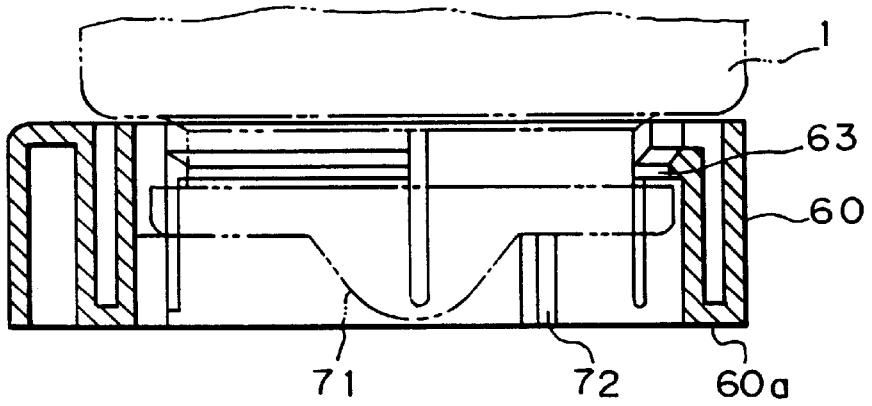

FIG. 20 shows an annular unreplaceable member 60 serving to stabilize the position of the container 1 at the time of cleaning or test. As shown, the member 60 has a flat bottom 60*a* and removably mounted to the container 1. The member 60, like the member 60 shown in FIGS. 6 and 7, prevents toner of unexpected kind from being replenished when only a single kind of containers 1. are used, as stated earlier. As shown in FIG. 21, the member 60 has on its inner periphery a plurality of ridges 63 and a plurality of stops 72. The ridges 63 are received is the groove 8 for locking the member 60 to the container body 2. The ridges 63 and stops 72 hold the projection 9 therebetween with play, so that the container 1 and member 60 are rotatable relative to each other.

The bottom 60*a* of the member 60 is positioned outside of the bottom 13 of the container 1 and perpendicular to the axis of the container 1. Therefore, when the member 60 is attached to the container 1, its bottom 60*a* is sustained and stabilizes the upright position of the container 1. In addition, the member 60 lowers the center of gravity of the container 1, further stabilizing the position of the container 1.

Furthermore, as shown in FIG. 21, the width of the member 60 is selected such that when the bottom 13 is formed with the recess 71, FIG. 19, the bottom 60*a* of the member 60 is positioned at a lower level than the lowermost point of the recess 71. This stabilizes even the container 1 with the recess 71 which is inherently unstable.

In the illustrative embodiment, a single projection 70 or a single recess 71 is positioned substantially at the center of the bottom 13 of the container 1. If desired, a plurality of projections 70 or a plurality of recesses 71 may be provided, or the projection 70 and recess 71 may be provided together. Air for cleaning the container 1 may be replaced with water or similar liquid.

5th Embodiment

Figure 22:
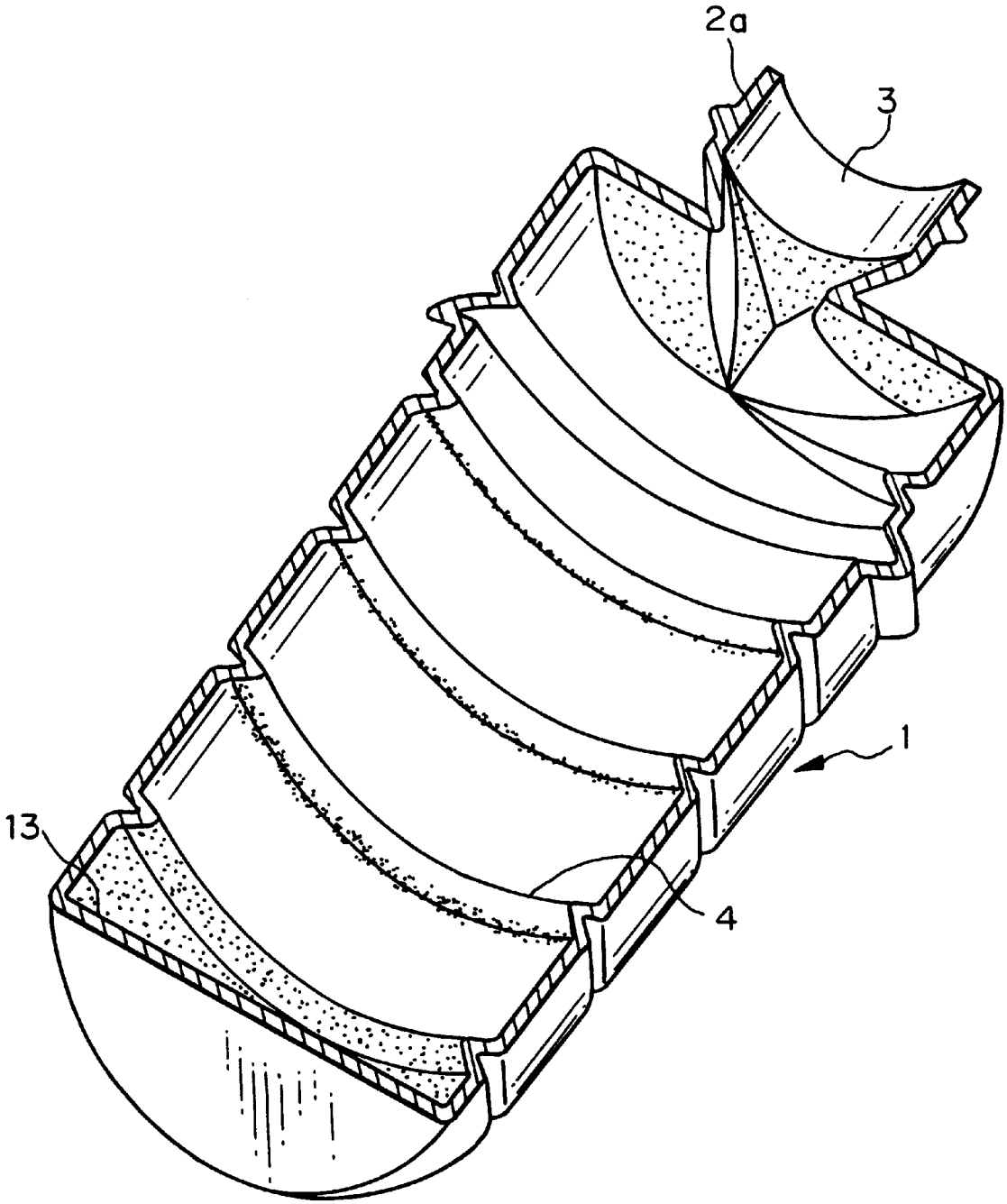
FIG. 22 is a sectional perspective view showing toner remaining in a toner container, particularly a spiral ridge, after cleaning.

This embodiment also implements a recyclable toner container capable of solving the problem (2) stated earlier. The fourth embodiment described above pays attention to the bottom 13 of the toner container 1 which is difficult to clean. By contrast, the fifth embodiment pays attention to the inner surfaces of the spiral ridge 4 which are also difficult to clean, as shown in FIG. 22. Particularly, the surface of the ridge 4 facing the bottom 13 is more difficult to clean than the surface of the same facing the toner outlet 3. This embodiment is applicable to all the toner containers having the spiral ridge 4.

Figure 23:
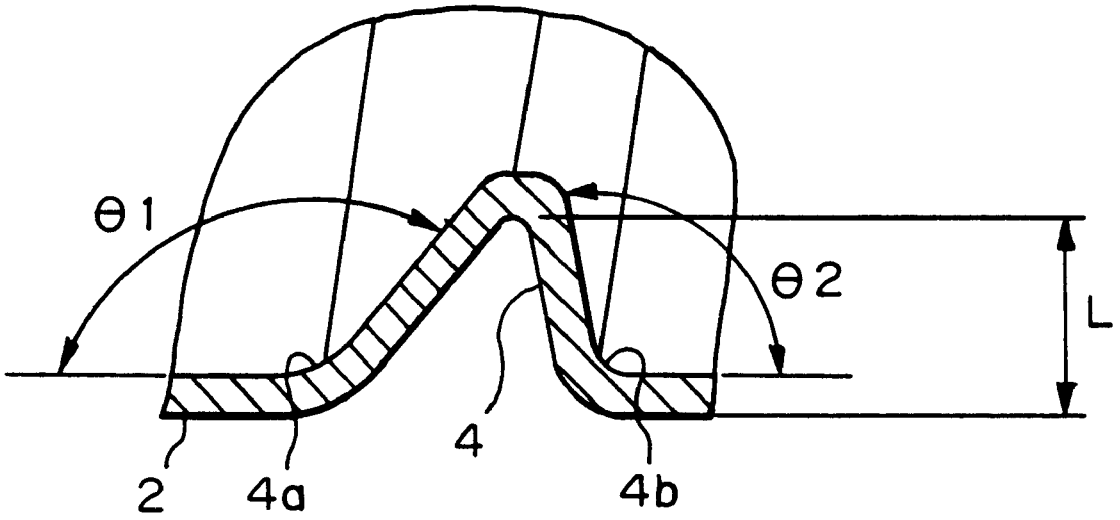
FIGS. 23 and 24 are fragmentary sections each showing a specific configuration of a spiral ridge representative of a fifth embodiment of the present invention.

Specifically, as shown in FIG. 23, the ridge 4 has its corner 4*a* closer to the bottom 13 than the other corner 4*b* rounded in order to allow a jet of air to easily blow off the toner. In the illustrative embodiment, the other corner 4*b* closer to the toner outlet 3 than the corner 4*a* is also rounded. The rounded corner 4*a* promotes easy removal of the toner therefrom and thereby reduces the amount of toner to remain there after cleaning.

Figure 24:
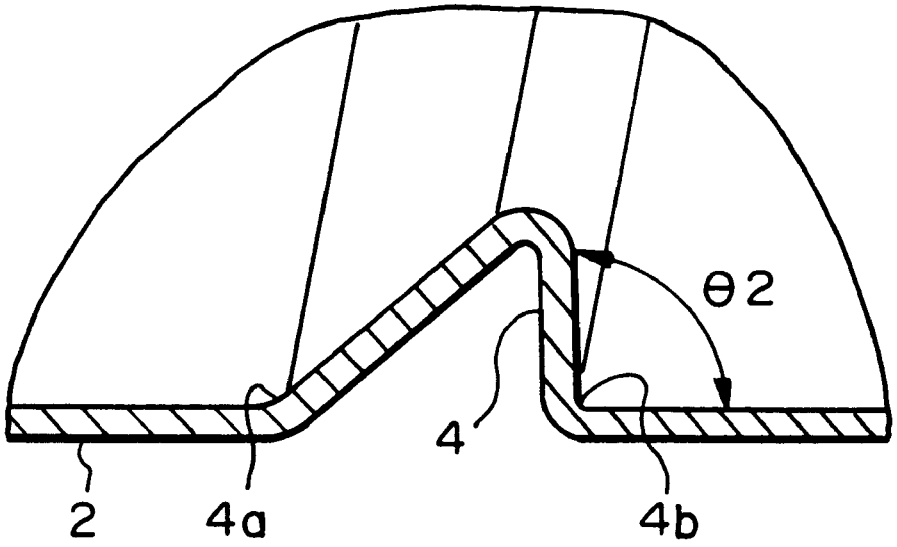

The ridge 4 conveys the toner toward the toner outlet 3 while the container 1 is rotated about its axis extending through the center of the outlet 3. At this instant, the force for conveying the toner is exerted by the surface of the ridge 4 facing the toner outlet 3, so that the toner to remain at the corner 4*b* after cleaning is smaller in amount than the toner to remain at the corner 4*a*. Considering this difference, the embodiment provides the corner 4*b*, i.e., the inner surface of the container body 2 and the surface of the ridge 4 facing the toner outlet 3 with an angle $\theta 2$ smaller than the angle $\theta 1$ between the corner 4*a*, i.e., the inner surface of the container body 2 and the other side of the ridge 4 facing the bottom 13. More preferably, the angle $\theta 2$ is selected to be substantially 90 degrees, as shown in FIG. 24. This not only insures a desirable toner conveying force, but also further reduces the amount of toner to remain at the corner 4*a* because the angel $\theta 1$ can be further reduced.

Figure 25:
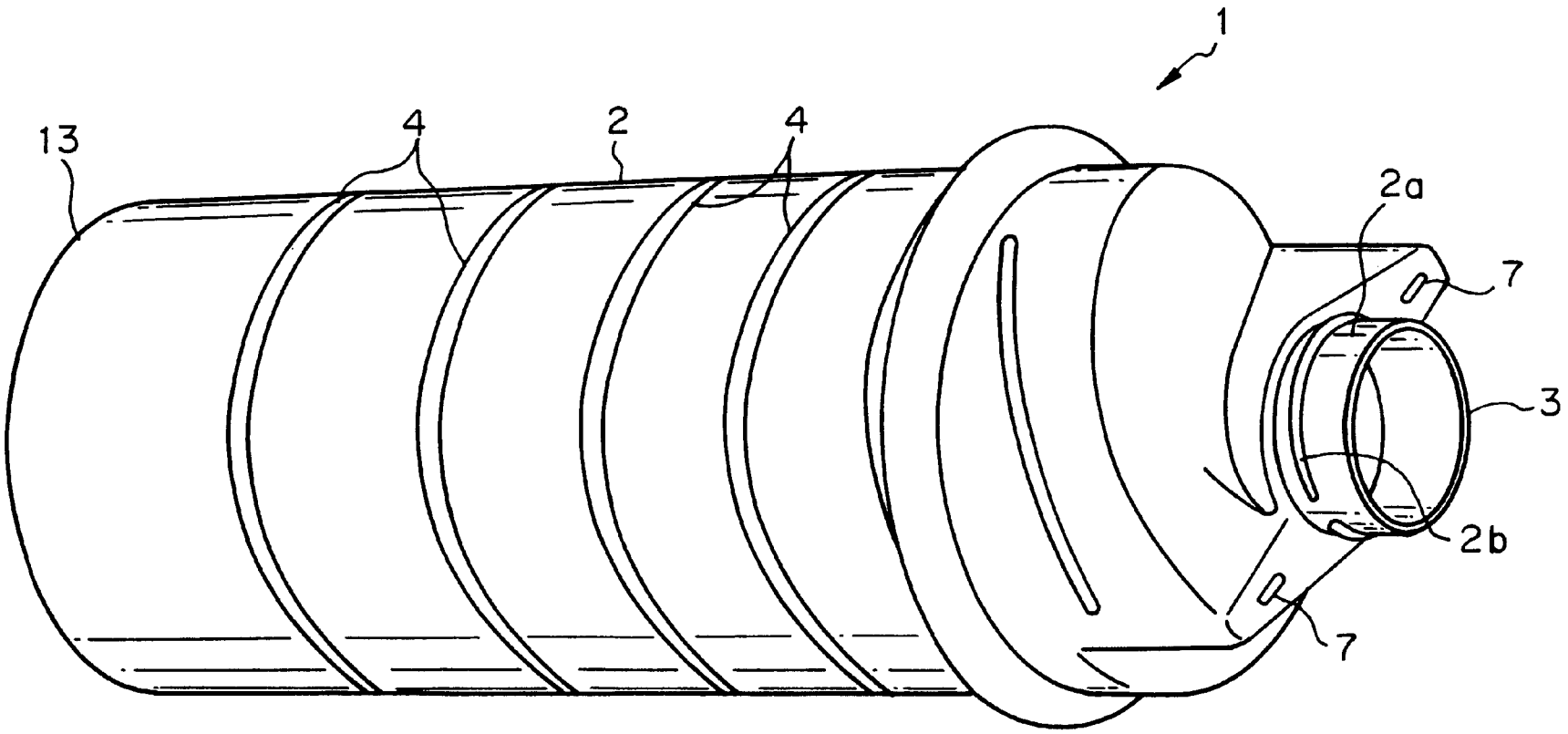
FIG. 25 is a perspective view showing a modification of the fifth embodiment.

The toner to remain on the surfaces of the ridge 4 sequentially increases, although not noticeably, as the distance between the ridge 4 and the bottom 13 decreases. This is presumably because the jet of air fails to flow smoothly in the portion close to the bottom 13. To solve this problem, in the illustrative embodiment, the ridge 4 has a greater pitch at the portion close to the bottom 13 than at the portion close to the toner outlet 3. Specifically, as shown in FIG. 25, the pitch of the ridge 4 is sequentially increased from the side adjoining the toner outlet 3 toward the side adjoining the bottom 13. Such a great pitch in the portion adjoining the bottom 13 promotes the smooth flow of air and thereby reduces to the toner to remain on the ridge 4.

Experiments showed that air easily blows off the toner the pitch of the ridge 4 is 3 cm or above, that the cleaning efficiency increases when the ridge 4 has a height L (see FIG. 23) of 1 cm or below, and that the cleaning efficiency also increases when the angle of the spiral of the ridge 4 is, e.g., 30 degrees or above.

6th Embodiment

Figure 26:
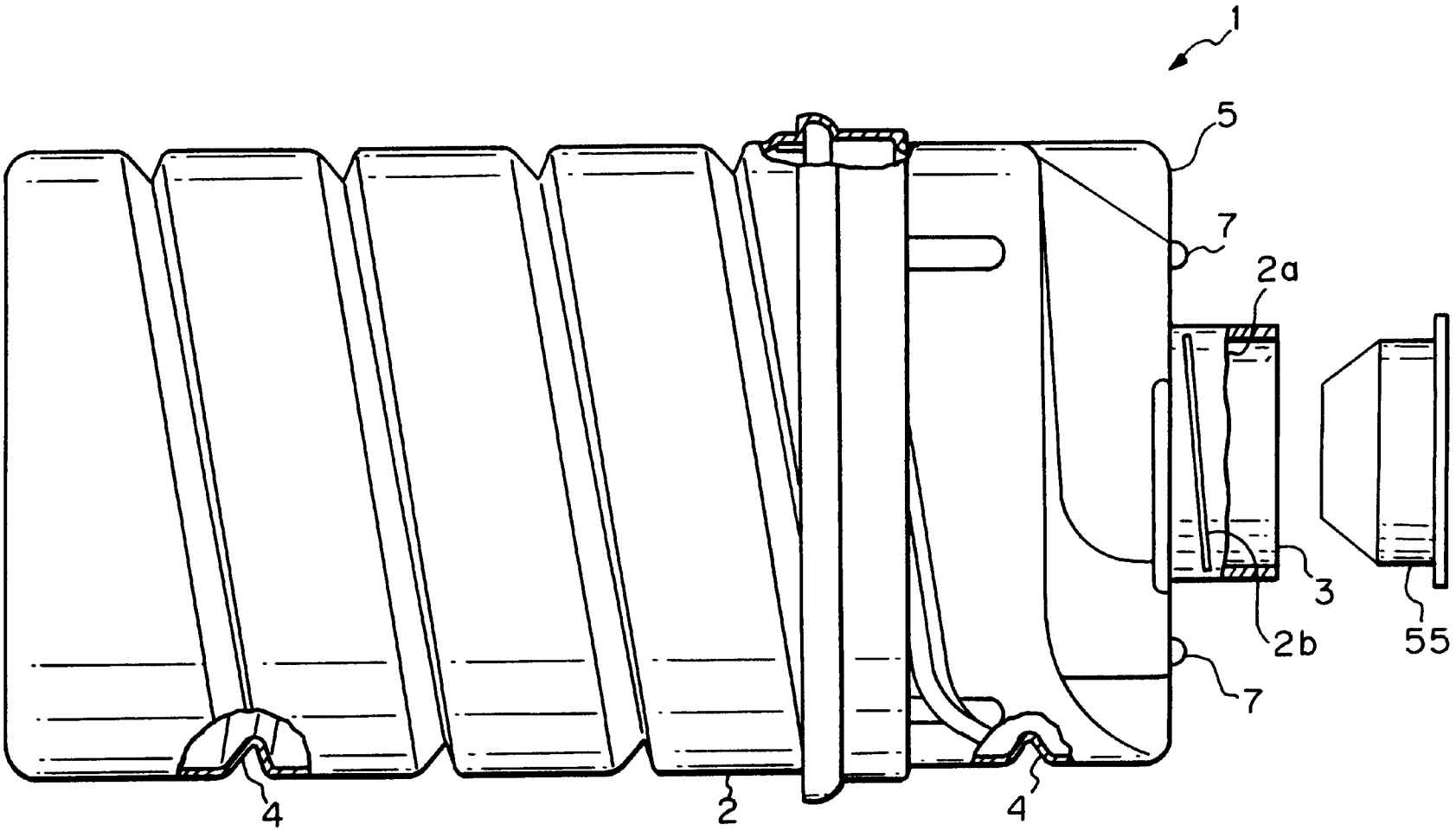
FIG. 26 shows a sixth embodiment of the toner container in accordance with the present invention.
Figure 27:
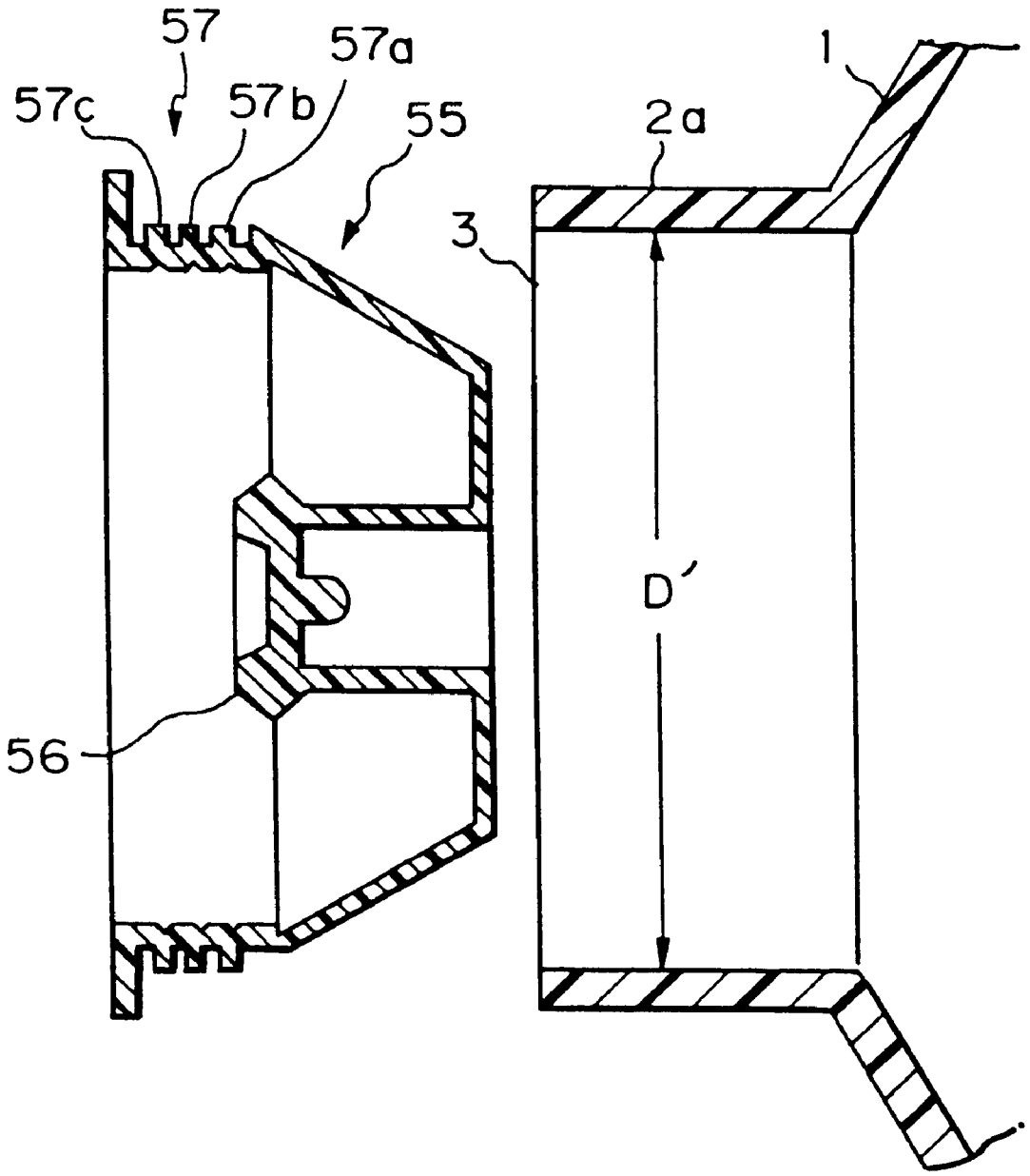
FIG. 27 is a section of a cap to be fitted on the container of the sixth embodiment.

This embodiment implements a recyclable toner container capable of solving the problem (3) stated earlier. As shown in FIG. 26, the toner container 1 is essentially similar to the container 1 of the second embodiment shown in FIGS. 10A and 10B. In the illustrative embodiment, a cap 55 is usually fitted in the collar 7*a*, closing the toner outlet 3. When the container 1 with the cap 55 is mounted to the copier, an automatic opening mechanism, not shown, automatically removes the cap 55 from the collar 2*a*. When the container 1 is to be removed from the copier, the opening mechanism automatically fits the cap 55 in the collar 2*a*. Whenever the operator mounts or dismounts the container 1, the toner outlet 2*a* is closed by the cap 55 and frees the operator from smearing. FIG. 27 shows the cap 55 in detail. As shown, the cap 55 includes a pin 56 which a chuck included in the automatic opening mechanism is capable of gripping.

If the cap 55 is loosely fitted in the toner outlet 3, the toner stored in the toner container 1 is apt to leak. If the cap 55 is excessively tightly fitted in the toner outlet 3, the automatic opening mechanism may fail to remove the cap 55 from the outlet 3. Therefore, the inside diameter of the toner outlet 3 and the outside diamter of the cap 55 are formed with some degree of accuracy. However, when the container 1 is collected for reuse, the inside diameter of the toner outlet 3 may have been slightly varied due to aging. The cap 55 fitted in such a toner outlet 3 might be excessively loose or excessively tight. Excluding containers 1 with such defective toner outlets 3 would reduce the number of toner containers to be reused and would thereby lower profit, as discussed earlier. In the illustrative embodiment, the container 1 can be reused even when the inside diameter of the toner outlet 3 is slightly varied.

Specifically, as shown in FIG. 27, the cap 55 is formed of a plastic soluble in a plastic constituting the container 1. While the container 1 and cap 55 may be formed of different materials if the materials are soluble in each other, they should more preferably be formed of plastics belonging to the same group. For example, when the container 1 is formed of hard polyethylene, then the cap 55 should also preferably be formed of polyethylene. When the container 1 is formed of another kind of plastic, the cap 55 should also preferably be formed of the same kind of plastic as the container 1.

As shown in FIG. 27, at least one protuberance 57 is formed on the outer periphery of the cap 55 which closely contacts the inner periphery of the collar 2*a*, as illustrated. In the illustrative embodiment, three protuberances 57*a*, 57*b* and 57*c* are a formed on the cap 55, and each is implemented as an annular protuberance. The annular protuberances 57*a*–57*c* each have a diameter D slightly greater than the inside diameter D of the collar 2*a* The protuberances 57*a*–57*c* are molded integrally with the cap 55. The protuberances 57*a*–57*c* each has a thickness smaller than the thickness of the collar 2*a* and is therefore softer and more elastic than the collar 2*a*. The difference in thickness for making the protuberances 57*a*–57*c* softer and more elastic than the collar 2*a* may be replaced with a difference in material. If desired, both the thickness and material may be taken into account.

When the cap 55 is inserted into the collar 2*a*, the protuberances 57*a*–57*c* slightly greater in diameter than the collar a slightly deform due to their elasticity and closely fit on the inner periphery of the collar 2*a*. In this condition, the protuberances 57*a*–57*c* surely seal the toner outlet 3. In addition, because the protuberances 57*a*–57*c* make substantially line-to-line contact with the inner periphery of the collar 2*a*, the cap 55 is prevented from being excessively tightly fitted in the collar 2*a*. It follows that the protuberances 57*a*–57*c* absorb any scattering in the inside diameter of the collar 2*a*, allowing the standard range relating to the inside diameter to be broadened. Therefore, even when the inside diameter of the collar 2*a* is slightly varied due to aging, the protuberances 57*a*–57*c* deform complementarily to the inside diameter and closely fit on the inner periphery of the collar 2*a*. Consequently, even a container 1 whose collar 2*a* is slightly deformed can be reused. the protuberances 57*a*–57*c* insure sealing due to their elasticity even when the collar 2*a* is only locally deformed or deformed in a shape different from a true circle.

With the illustrative embodiment, it is possible to reduce the number of toner containers to be rejected by an inside diameter test, and therefore to enhance the profit of reuse. In addition, because the standard range relating to the inside diameter of the toner container is broadened, a minimum number of newly produced toner containers will be rejected.

Figure 27A:
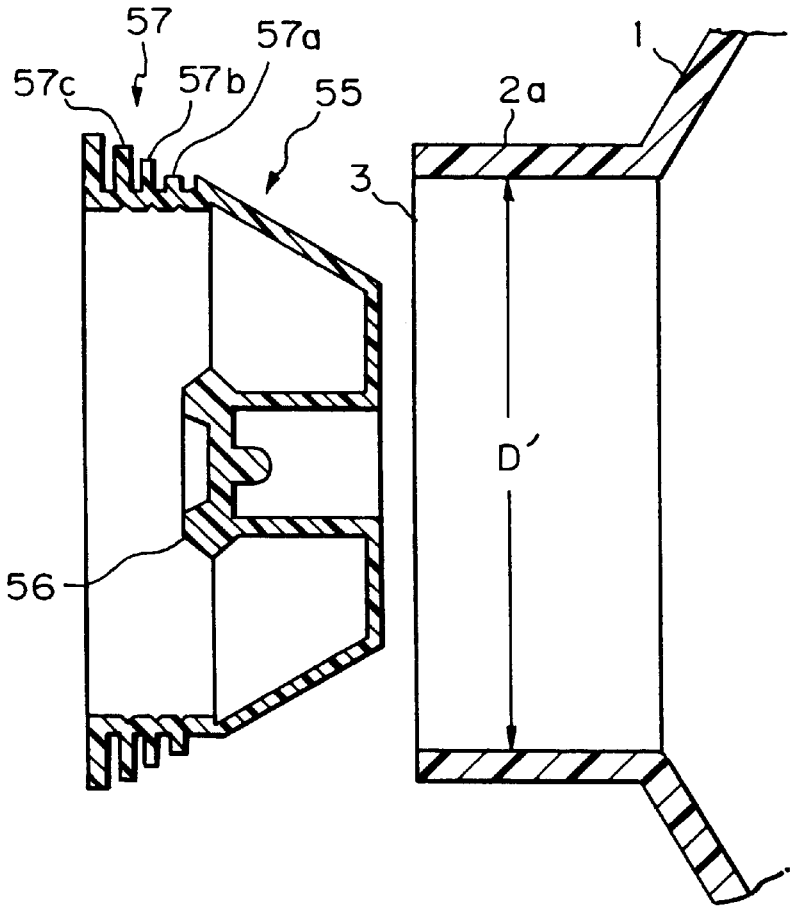
FIG. 27A illustrates protuberances formed on an outery periphery of the cap shown in FIG. 27.
Figure 28:
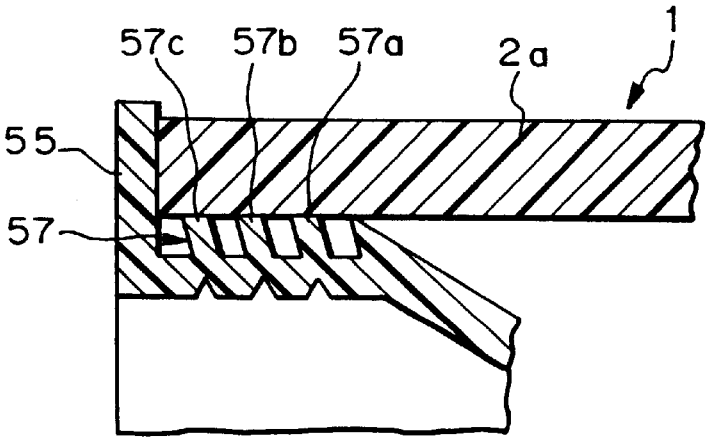
FIG. 28 is a section showing the cap of FIG. 27 fitted in the container.

While the three protuberances 57*a*–57*c* may be replaced with a single protuberance, a plurality of protuberances are more desirable in achieving the above advantages. When two protuberances are provided, one of them positioned at the upstream side in the direction of insertion of the cap 55 may be provided with a slightly greater diameter than the other positioned at the downstream side. Further, when three protuberances 57*a*–57*c* are provided, as shown in FIG. 27A, the diameter of the protuberances 57*a*–57*c* may be sequentially increased from the downstream side toward the upstream side in the direction of insertion of the cap 55. With such an alternative configuration, it is possible to increase the range over which the protuberances 57*a*–57*c* can cope with the inside diameter of the collar 2*a*, and therefore to increase the number of toner containers that can be reused.

Even if the toner container 1 cannot be simply reused, it can be shreded into pellets, melted, and then molded together with the cap 55 because the container 1 and cap 55 are formed of plastics soluble in each other.

7th Embodiment

This embodiments implements a recyclable toner container capable of solving the problem (3) stated earlier, particularly a toner container whose toner outlet 3 can be easily subjected to an inside diameter test. In this embodiment, the toner container 1 is formed with the ridge or ridges 2*b* at least on the outer periphery of the collar 2*a*. The collar 2*a* is therefore scarcely deformable and can be easily tested as to the inside diameter of the toner outlet 3. This embodiment is therefore applicable to all the toner containers having the ridge or ridges 2*b*.

Figure 29:
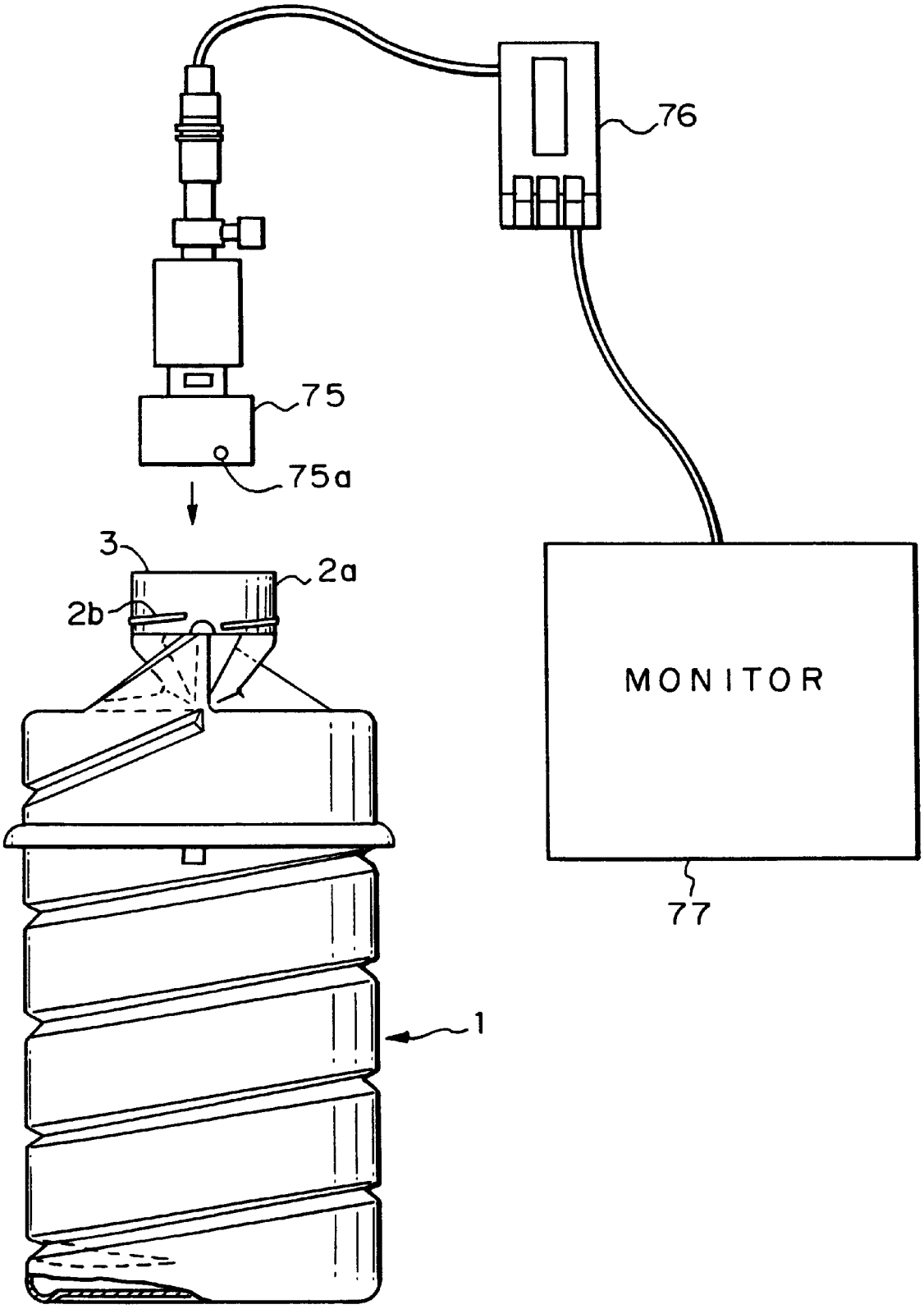
FIG. 29 shows a specific arrangement for testing the inside diameter of a toner container representative of a seventh embodiment of the present invention.

FIG. 29 shows a specific arrangement for testing the inside diameter of the toner outlet 3 of the above toner container 1. As shown, the container 1 is held in its upright position by a fixing device, not shown. Then, an attachment 75 provided with three contact points 75*a* is inserted into the toner outlet 3 and caused to contact the will of the toner outlet 3. A sensor 75 reads the displacement of the individual contact point of the attachment 75. The operator, watching a monitor 77, determines whether or not the displacements lie in a standard range. If the displacements do not lie in the standard range, the container 1 is excluded from the reusing process as a defective toner container.

As stated above, the collar 2*a* is formed with the ridge or ridges 2*b* over at least a part of its circumference, its configuration remains stable although the toner container 1 may be relatively soft. Therefore, the container 1 can have the inside diameter of its collar 2*a* tested smoothly and rapidly.

8th Embodiment

This embodiment implements a toner container capable of solving the problem (4) stated earlier. Briefly, the toner container 1 to be described is provided with an indication showing how many times the container 1 can be recycled. With this indication, it is possible to easily determine whether or not the toner container 1 will withstand reuse when collected.

Figure 30:
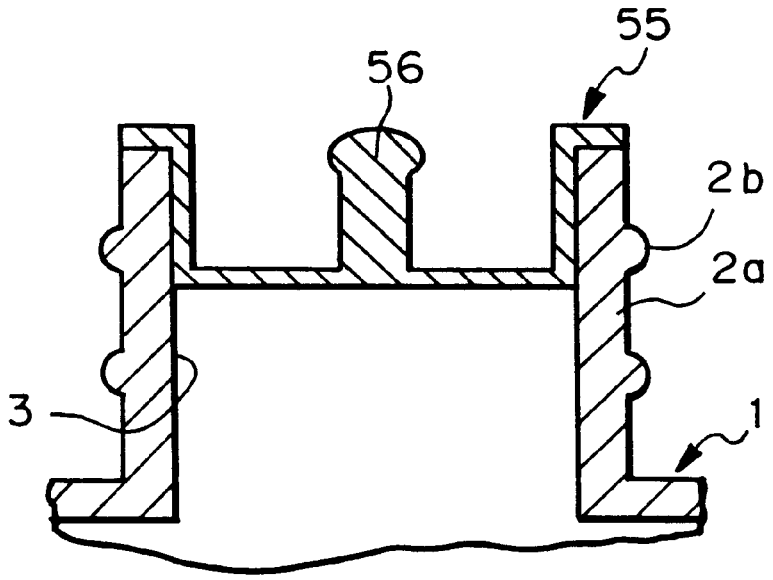
FIG. 30 shows a cap fitted in a toner container representative of an eighth embodiment of the present invention.

Speically, as shown in FIG. 30, the cap 55 fitted in the collar 2*a* of the toner container 1 is provided with the above indication. The cap 55 refers not only to the gap 55 shown in FIG. 27 but also to all the caps used for the same purpose as the cap 55.

The cap 55 shown in FIG. 30 is formed of a white, green, blue or similar color resin. For example, the cap 55 formed of a white resin shows that the container 1 cannot be recycled at all. The cap 55 formed of a green resin shows that the container 1 can be recycled once. The cap 55 formed of a blue resin shows that the container 1 can be recycled twice. In this manner, how many times the container 1 can be recycled is indicated by the color of the cap 55. The cap 55 formed of a red resin, for example, shows that the container 1 has reached its upper limit as to the number of times of recycling.

When a great number of such containers 1 are collected, they are classified by the color of their cap 55. The containers 1 which can be recycled are cleaned, examined as to appearance, and then refilled with toner. Subsequently, a cap 55 of particular color is fitted on each of the refilled containers 1, showing how many times the container 1 can be. further recycled. For example, if a green cap 55 is fitted on the collected container 1, then it is replaced with a blue cap 55. If a red cap 55 is fitted on the collected container 1, then the container 1 is delivered to a molding line or simply discarded Such an indication scheme is desirable for the following reasons. In the container 1, the inner periphery of the collar 2*a* wears due to repeated recycling with the result that a gap is produced between the collar 2*a* and the cap 55. The gap is apt to allow the toner to leak therethrough. Further, when the container 1 is laid on the rack 44, FIGS. 3 and 4, sideways and rotated to replenish its toner, the container 1 and the seat portion 44*a* of the rack 44 slide on each other. This causes the toner container 1 to wear and disfigures it due to repeated recycling.

Figure 31:
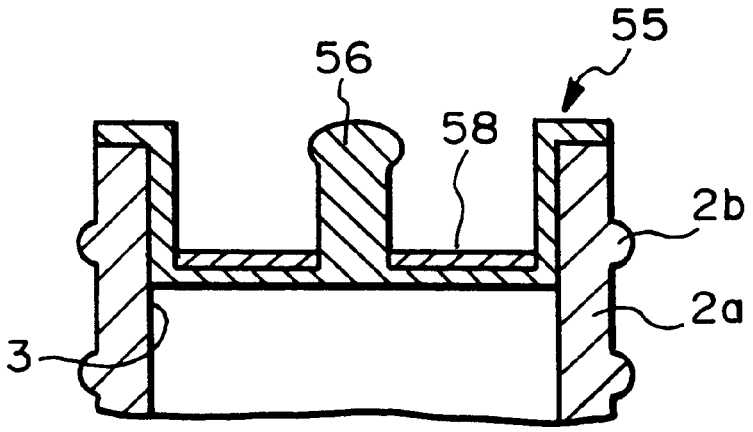
FIG. 31 is a vertical section showing a modification of the eighth embodiment.

The cap 55 shown in FIG. 30 is colored itself. Alternatively, as shown in FIG. 31, a piece of color paper 58 may be adhered to the cap 55 formed of, e.g., a white resin. In the event of recycling, the cap 55 with the paper 58 may be bodily replaced, or only the paper 58 may be replaced.

Figure 32:
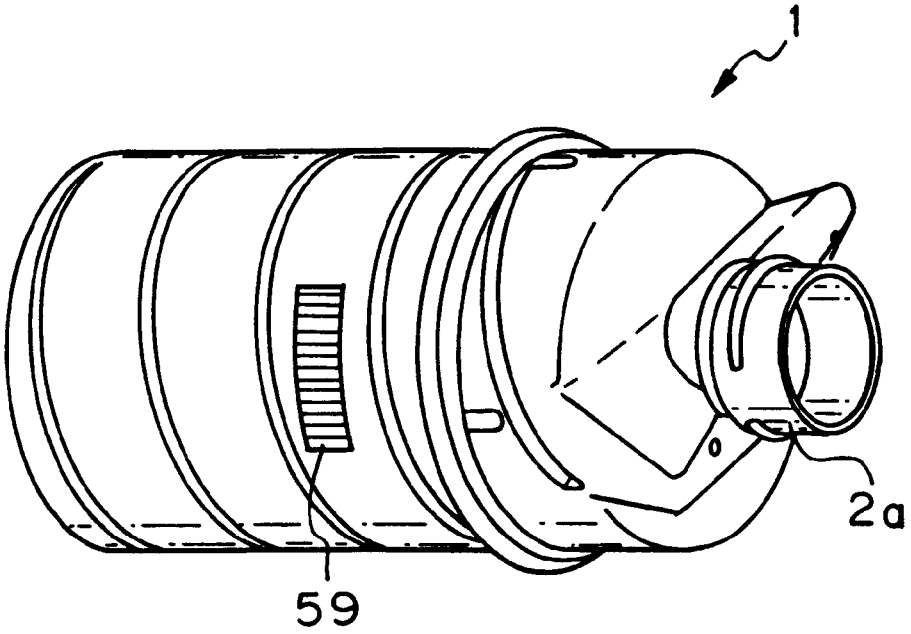
FIG. 32 is an external view showing another modification of the eighth embodiment.
Figure 33:
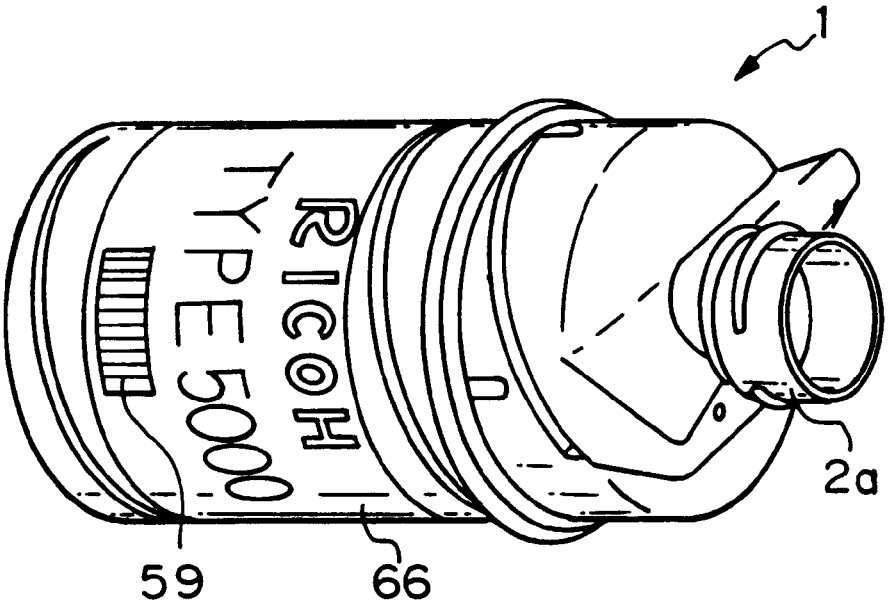
FIG. 33 is an external view showing still another modification of the eighth embodiment.

Further, as shown in FIG. 32, a bar code label 59 showing the number of times of recycling may be directly adhered to the toner container 1, in which case a sensor will be used to automatically read the label 59. If desired, as shown in FIG. 33, the bar code label 59 may be adhered to a trademark label which is adhered to the container 1. In this case, the trademark label 66 with the bar code label 59 may be bodily replaced, or only the bar code label 59 may be replaced, The indication in the form of a color or a bar code label may be provided on the shoulder portion 5 or the bottom 13 of the container 1 or even on the unreplaceable member 60, FIGS. 6 and 7, if necessary.

Of course, the color or the bar code label shown and described may be replaced with any other suitable kind of indication, e.g., numerals, symbols or color labels. Particularly, when the unreplaceable member 60 is used, it may be formed with a suitable recess or notch indicative of a particular number of times of recycling of the toner container 1 to which the member 60 is attached

9th Embodiment

This embodiment implements a recyclable toner container capable of solving the problem (5), particularly a toner container meeting the flare-retardation standard UL94-HB prescribed by the plastic container control law enforced by the State government of California, U.S.A.

For experiments, PCR (HDPE) available from Enviroth-ene and HDPE available from Paxon were used as a reclaimed material and a virgin material, respectively. The physical properties of PCR, virgin material and their mixture were measured. Table 1 shown below lists the results of measurement.

TABLE 1

| | ASTM | Condition | Unit | A PCR 100% | B PCR 75% Virgin 25% | C PCR 50% Virgin 50% | D PCR 25% Virgin 75% | E Virgin 100% | Remarks |
|---|---|---|---|---|---|---|---|---|---|
| Melt Flow Rate | D1238 | 190° C. | g/10 min | 0.7 | 0.5 | 0.5 | 0.4 | 0.3 | Test |
| Izod | D256 | 23° C. | Kgf · cm | 14 | 14 | 14 | 13 | 14 | Condition |
| Impact Strength | with notch | −20° C. | /cm$^2$ | — | — | — | — | — | Load |
| Tension | | | | | | | | | 2.16 Kg |
| Yield Strength | D638 | | Kgf/cm$^2$ | 310 | 315 | 290 | 290 | 295 | Sample |
| Elongation | | | | 105 | 85 | 110 | 125 | 85 | Length |
| Flexure | | | | | | | | | ¼ Inch |
| Strength | D730 | | Kgf/cm$^2$ | 220 | 215 | 215 | 200 | 195 | |
| Modulus of Elasticity | | | | 9100 | 8700 | 8300 | 8200 | 7400 | |
| Rockwell's Hardness | D786 | | R scale | 60 | 57 | 54 | 54 | 53 | |
| Deflection Temperature | D648 | 4.6 Kg | ° C. | 85 | 82 | 80 | 80 | 76 | |
| under Load | | 18.6 Kg | ° C. | — | — | — | — | — | |
| Specific Gravity | D792 | | | 0.95 | 0.95 | 0.95 | 0.95 | 0.94 | |
| Mold Shrinkage | Isomo Method (MD) | | % | 3.1 | 3.2 | 2.8 | 2.8 | 3.0 | |

As Table 1 indicates, PCR tends to increase a melt flow rate, flexural strength, flexural modulus. Rockwell's hardness, deflection temperature under load, and specific gravity. The problem is how such variations of physical properties influence the combustibility of the material of bottles. A combustibility test referred to as UL 94 (horizontal combustibility test) was conducted with each of the compositions listed in Table 1.

Figure 34:
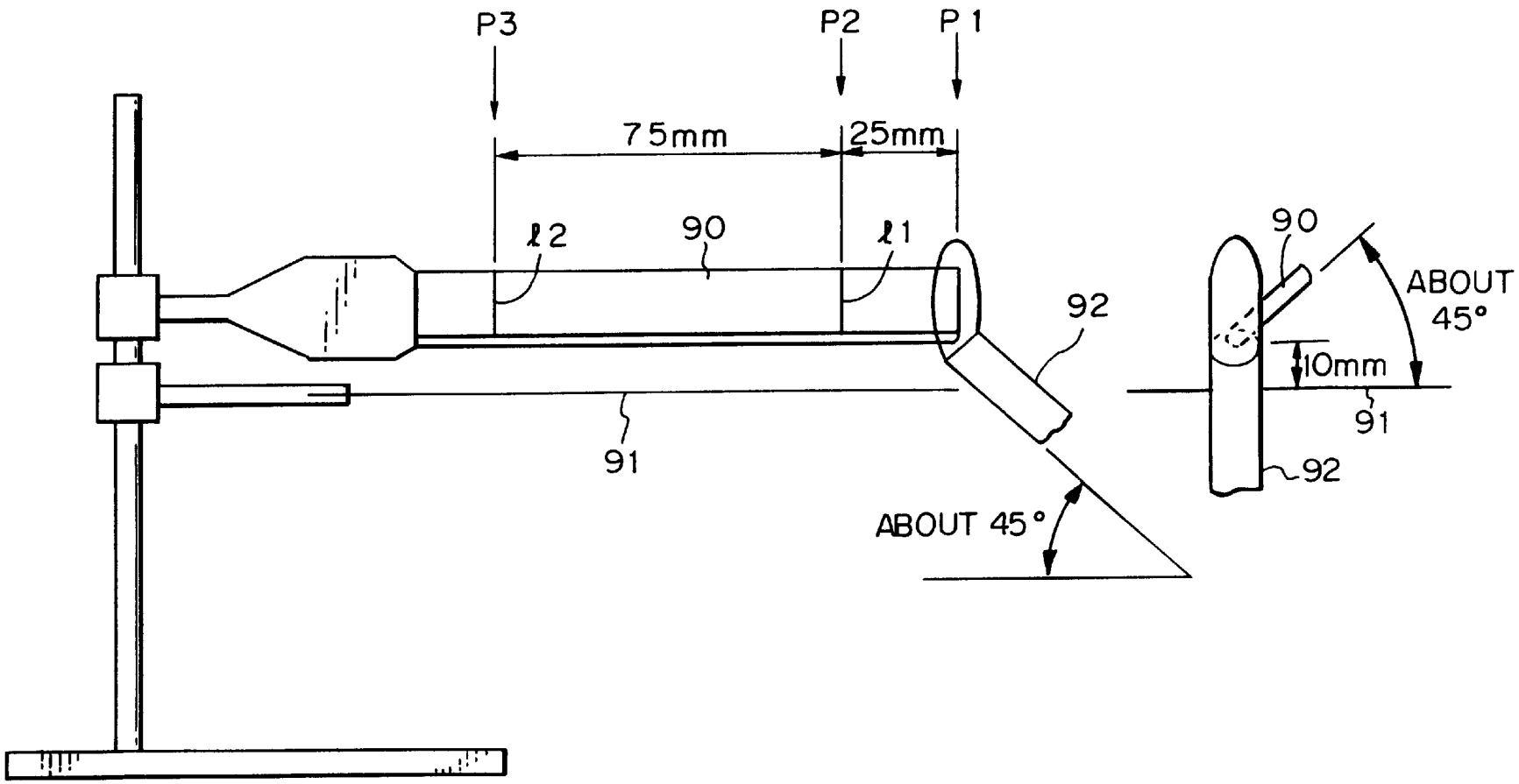
FIG. 34 demonstrates a horizontal combustibility test for testing a toner container representative of a ninth embodiment of the present invention.
Figure 35:
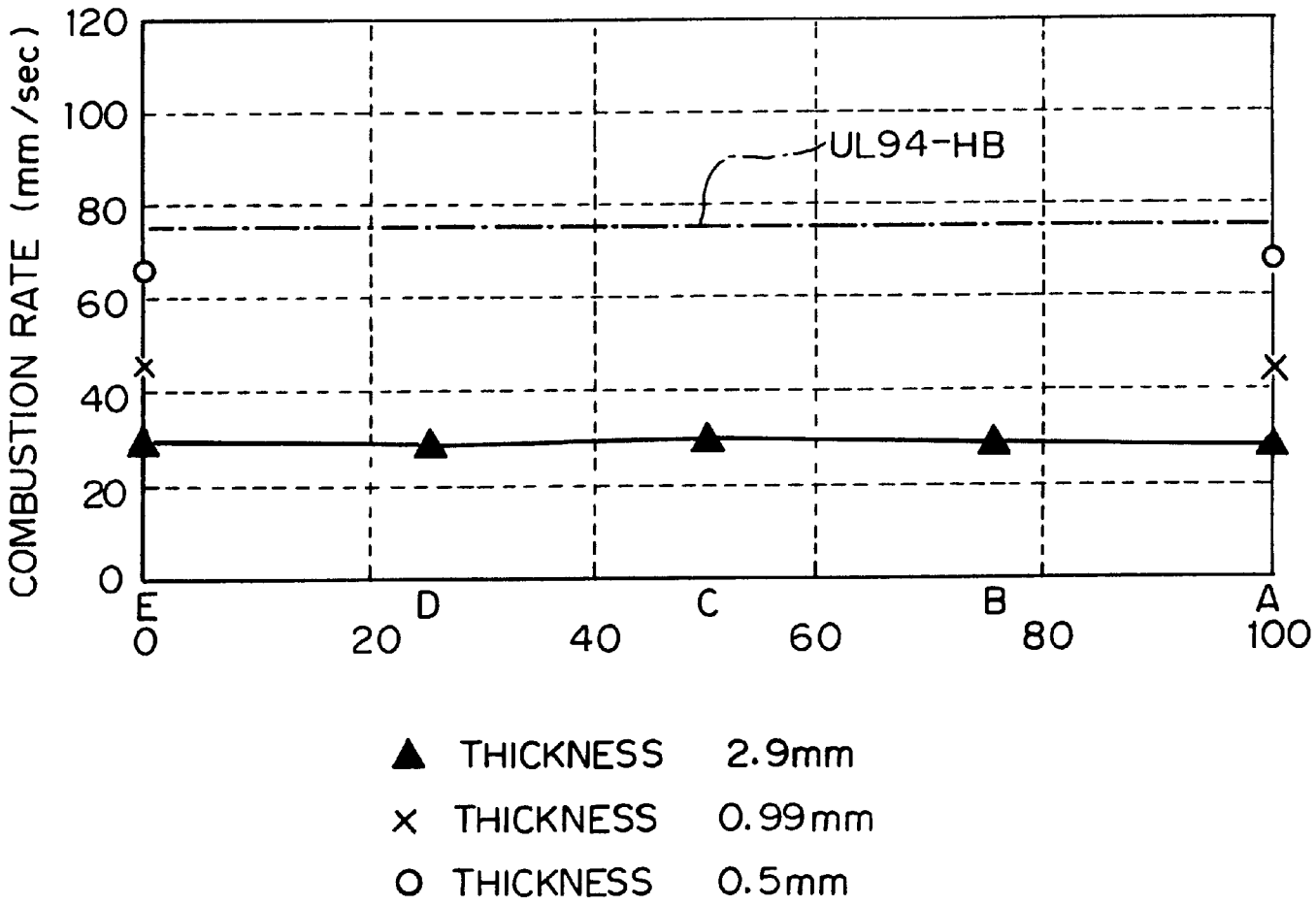
FIG. 35 is a graph showing a relation between a PCR mixture ratio and a combustion rate determined by the test of FIG. 34.

Three samples of each of the compositions A–E were tested. As shown in FIG. 34, two lines $l_1$ and $l_2$ were drawn on each sample 90 perpendicularly to the longitudinal axis of the sample 90. The lines $l_1$ and $L_2$ were respectively located at positions P2 and P3 spaced by 25 mm and 100 mm from a firing point P1. The sample 90 was fixed at its one end adjoining the position P3. The sample 90 has its longitudinal axis held horizontal and has its lateral axis held at an angle of about 45 degrees. A wire net 91 was positioned below the sample 90 and fixed in a horizontal position. The lowest edge of the sample 90 and the wire net 91 were spaced by 10±1 mm. The free cad of the sample 90 and the edge of the wire net 91 were held linear.

A burner 92 was fired at a position remote from the sample 90 and adjusted to send a blue flame having a height of 230±1 mm. Specifically, the feed of a gas and the air inlet of the burner 92 were so adjusted as to cause the burner 92 to send an about 20 mm high blue flame having a yellowish tip. The amount of air was increased until the yellowish tip disappeared. Then, the height of the flame was again measured in order to readjust the flame, as needed.

The flame issuing from the burner 92 was applied to the lower free edge of the sample 90, The axis of the burner 92 was laid in the same vertical plane as the lower edge of the vertical axis of the sample 90 and was inclined by about 45 degrees relative to the end of the sample 90 in a horizontal. plane. The burner 92 was adjusted in position such that the flame contacts the free end of the sample 90 up to a depth of 6±1 mm. In this condition, the sample 90 was continuously burned for 30 seconds. When the end of the sample 90 being burned reached the 25 mm line $l_1$ on the elapse of or within 30 seconds, the burner 92 was moved away from the sample 90. Time started to be count at the instant when the baling end of the sample 90 reached the 25 mm line $l_1$.

When the sample 90 continuously burned after the removal of the flame, the interval between the time when the burning end reached the 25 mm line $l_1$ and the time when it reached the 100 mm line $l_2$ was counted in second and recorded together with the burned length. When the burning end of the sample 90 did not reach the 100 mm line $l_2$, the interval between the burning end of the sample 90 reached the 25 mm line $l_1$ and the time when it disappeared and the burned length were recorded in second and millimeter, respectively.

The linear combustion rate V of each sample 90 was produced by:

$$V=60L/t$$

where V denotes a linear combustion rate V (mm) per minute, L denotes a burned length (mm) (when the burning end passes the 100 mm line $l_2$, L is 75 mm), and t denotes time.

All the samples 90 of the materials A–E thinner than 3.0 mm meet the UL94 standard if their combustion rates do not exceed 75 mm/sec between the positions P2 and P3 spaced by 75 mm. Even the plastics B–D containing PCR or the plastic A consisting only of PCR meet the UL94 standard if their thicknesses are 0.5 mm or above. Of course, because PCR tends to increases the melt flow rate more than the virgin material, molding conditions must be so controlled as to match the thickness to the above dimension.

On the other hand, when toner containers are recycled for reuse, they are cleaned, have their labels removed, and then undergo inside diameter tests and appearance tests, At the same time, whether or not any toner is left in the containers is determined, as stated earlier. For this purpose, while a container is caused to rotate about is own axis, high frequency light is cast on the outer periphery of the container. A CCD (Charge Coupled Device) camera reads black portions of the container being illuminated. Subsequently, a computer is used to distinguish the shadow of the container and the toner remaining therein by bilevel decision, Therefore, the container cannot be tested if excessively thick. Containers formed of the previously stated materials should be less than 1 mm thick.

As stated above, even when PCR is mixed with a virgin material according to the plastic container control law of California, a toner container meeting the UL94-HB standard is achievable if it is 0.5 mm thick or above. Such a toner container is applicable to an image forming apparatus. Further, even a toner container formed only of PCR can meet the UL 94-HB standard if it is 0.5 mm thick or above.

Various modifications will become possible for those skilled in the art after receiving the teachings of the present disclosure without departing from the scope thereof.

What is claimed is:

1. A recyclable toner container for storing toner to be replenished into a developing device of an image forming apparatus, said toner container comprising:

a hollow cylindrical container body;

a toner outlet formed in one end of said container body; and a cap removably fitted in said toner outlet;

said cap having a plurality of circumferential protuberances on an outer periphery thereof contacting an inner periphery of said toner outlet, wherein diameters of the plurality of protuberances are sequentially increased from a downstream side toward an upstream side in a direction in which said cap is inserted into said toner outlet.

2. A toner container as claimed in claim 1, wherein said plurality of protuberance is softer and more elastic than the inner periphery of said toner outlet.

3. A toner container as claimed in claim 1, wherein said cap and said container body include plastics soluble in each other.

* * * * *